US006257574B1

(12) United States Patent
Evans

(10) Patent No.: US 6,257,574 B1
(45) Date of Patent: Jul. 10, 2001

(54) MULTI-POLYHEDRAL PUZZLES

(76) Inventor: Harriet S. Evans, 2174 N. Cross Dr., Shreveport, LA (US) 71107

( * ) Notice: Subject to any disclaimer, the term of this patent is extended or adjusted under 35 U.S.C. 154(b) by 0 days.

(21) Appl. No.: 09/370,929

(22) Filed: Aug. 5, 1999

Related U.S. Application Data

(60) Provisional application No. 60/104,666, filed on Oct. 16, 1998.

(51) Int. Cl.[7] ..... A63F 9/08
(52) U.S. Cl. ..... 273/157 R
(58) Field of Search ..... 273/157 R, 156, 273/153 R, 160

(56) References Cited

U.S. PATENT DOCUMENTS

| | | | | |
|---|---|---|---|---|
| 1,471,943 | * | 10/1923 | Chambers | 273/157 R |
| 2,041,030 | * | 5/1936 | Sutton | 273/157 R |
| 2,216,915 | * | 10/1940 | Johnson | 273/157 R |
| 2,839,841 | * | 6/1958 | Berry | 273/157 R |
| 3,637,216 | | 1/1972 | Keister | 273/156 |
| 3,645,535 | * | 2/1972 | Randolph | 273/157 R |
| 3,655,201 | | 4/1972 | Nichols | 273/153 R |
| 3,659,360 | * | 5/1972 | Zeischegg | 273/157 R |
| 3,712,622 | * | 1/1973 | Odier | 273/157 R |
| 4,258,479 | | 3/1981 | Roane . | |
| 5,108,100 | * | 4/1992 | Essebaggers et al. | 273/157 R |
| 5,338,034 | | 8/1994 | Asch | 273/155 |
| 5,344,148 | | 9/1994 | Asch | 273/156 |
| 5,407,201 | | 4/1995 | Whitehurst | 273/157 R |
| 5,660,387 | * | 8/1997 | Stokes | 273/157 R |

* cited by examiner

*Primary Examiner*—Steven Wong
(74) *Attorney, Agent, or Firm*—John M Harrison

(57) ABSTRACT

Multi-polyhedral puzzles characterized by four tetrahedra and one octahedron which are divided into different sets of multiple polyhedron blocks having various configurations, each block having multiple faces and each face being one of several colors. In a preferred embodiment the polyhedron blocks of each octahedron or tetrahedron set are fitted together in a corresponding transparent case to form the octahedron or tetrahedron, according to one of three levels of difficulty. At the most advanced level of difficulty in assembling each octahedron and tetrahedron, the polyhedron blocks of each set are fitted together such that abutting faces of adjacent polyhedron blocks match in color and a prescribed color pattern is formed on the respective faces of the assembled octahedron or tetrahedron. At an intermediate level of difficulty, the polyhedron blocks are fitted together to form the prescribed color pattern on the faces of the assembled octahedron or tetrahedron without regard to matching colors of abutting polyhedron block faces. At an elementary level of difficulty, the polyhedron blocks are fitted together to form the corresponding octahedron or tetrahedron without regard to matching colors of abutting polyhedron block faces or formation of the prescribed color pattern on the faces of the assembled octahedron or tetrahedron. The assembled tetrahedra can be arranged on respective faces of the assembled octahedron to form a large tetrahedron, for packaging or storage purposes.

9 Claims, 17 Drawing Sheets

MULTI-POLYHEDRAL PUZZLES

CROSS-REFERENCE TO RELATED APPLICATIONS

This application claims the benefit of copending U.S. Provisional Application Serial No. 60/104,666, filed Oct. 16, 1998.

BACKGROUND OF THE INVENTION

1. Field of the Invention

This invention relates to geometric puzzles and more particularly, to multi-polyhedral puzzles characterized by four tetrahedra and an octahedron which are divided into respective sets of multiple polyhedron blocks having various configurations, each face of each polyhedron block being one of multiple colors. In a preferred embodiment each octahedron or tetrahedron is divided into a set of polyhedron blocks which is different from the others. In solving the puzzles, each of the octahedron and four tetrahedra is assembled from the corresponding set of polyhedron blocks in an octahedron or tetrahedron-shaped transparent case, according to one of three levels of difficulty. At the most advanced level of difficulty, the octahedron and each of the tetrahedra are assembled from the polyhedron blocks such that abutting faces of adjacent polyhedron blocks match in color and a prescribed color pattern is formed on the respective faces of the octahedron or tetrahedron. At an intermediate level of difficulty, the polyhedron blocks are fitted together to form the prescribed color pattern on the faces of the assembled octahedron or tetrahedron, without regard to matching colors of abutting polyhedron block faces. At the elementary level of difficulty, each of the octahedron and tetrahedra is assembled from the polyhedron blocks irrespective of matching colors of abutting faces on adjacent polyhedron blocks and color pattern formation on the respective faces of the assembled octahedron or tetrahedron. The assembled tetrahedra can be arranged on respective faces of the assembled octahedron to form a large tetrahedron, for storage or packaging purposes.

2. Description of the Prior Art

Puzzles have entertained and amused mankind for centuries. In some cases, puzzles have served as educational or instructional tools, in addition to entertainment. A variety of two-dimensional puzzles and games which aid in learning the relationships of similar designs on planar surfaces, are described in such books as "Mathematical Magic Show", by Martin Gardner (1978) and "Puzzles Old and New", by Lewis Hoffman (1893).

Three-dimensional puzzles which require the assembly of smaller three-dimensional structures into a final, larger structure are well known. Comprehensive books have been written which describe a variety of such puzzles, for example, "Puzzles Old and New- How To Make and Solve Them", by J. Slocum and J. Botermans. Most of the three-dimensional puzzles known in the art do not require that designs or indicia on the surfaces of puzzle components be matched in order to complete the puzzle, only that the pieces be assembled to form the final structure. An example of such a puzzle was described in 1970 by House of Games in Canada, which included a cubic puzzle including thirteen rectangular pieces having nine colors disposed on their surfaces. Solving the puzzle requires locating nine different colors on each exposed surface of the final cubic structure. U.S. Pat. No. 3,788,645, discloses a mathematical cube puzzle in which four separate cubes have on each of their edges, one of a set of three color patterns. The object of the puzzle is to arrange the various cubes relative to one another such that the colors associated with all exposed adjacent playing edges of different cubes match one another. The puzzle has multiple solutions and the pieces can be arranged into a wide variety of different shapes, few of which are symmetrical. The educational value of the puzzle lies in facilitating an understanding of mathematical combinations, but the puzzle teaches little about three-dimensional geometric relationships. A number of U.S. patents, in particular U.S. Pat. Nos. 3,637,216 and 3,655,201, describe novel three-dimensional mechanical device puzzles. The mechanical device puzzles detailed in those patents are characterized by multiple pieces which are permanently attached to one another and do not provide the puzzle solver with three dimensional geometric concepts and spatial relationships while solving the puzzle. Although the puzzles provide the solver with the challenge of matching colors or indicia on exposed surfaces of the puzzle pieces, matching the internal surfaces of the pieces is not an object in solving the puzzle. A puzzle called "Instant Insanity" requires matching colors on the faces of four cubes and has only one solution, which is achieved by trial-and-error. No logic is required to solve the puzzle and the final solution is not a true three-dimensional solution. Thus, the puzzle does not provide education in three-dimensional spacial relationships.

Several U.S. patents describe three-dimensional puzzles which are assembled by fitting together multiple, smaller three-dimensional shapes. Typical of these puzzles is the "Tetrahedron Blocks Capable of Assembly Into Cubes and Pyramids", detailed in U.S. Pat. No. 4,258,479, dated Mar. 31, 1981, to Patricia A. Roane. The puzzle of that invention includes three sets of tetrahedron blocks, each set capable of assembly into a cube, with all the cubes being identical in size. The faces of adjacent tetrahedron blocks magnetically attract each other for assembly into the cube structure. Preferably, the tetrahedron blocks are colored in such a manner that faces of the same size and shape are colored alike, and faces of different sizes and shapes have different colors. U.S. Pat. No. 5,338,034, dated Aug. 16, 1994, to Sabine Asch, discloses a "Three-Dimensional Puzzle" including multiple, irregular pyramids which are assembled into a regular tetrahedron. The apexes of the irregular pyramids all meet at one point in the interior of the in the assembled tetrahedron, and the bases of the irregular pyramids form the regular tetrahedron surfaces. Another "Three-Dimensional Puzzle" to Sabine Asch, is described in U.S. Pat. No. 5,344,148, dated Sep. 6, 1994. The puzzle includes multiple puzzle bodies which are fitted together as chain links to form a chain. The chain can be folded to shape a desired polyhedron such as a tetrahedron, cube or octahedron, for example. U.S. Pat. No. 5,407,201, dated Apr. 18, 1995, to Timothy D. Whitehurst, describes an "Educational Puzzle and Method of Construction". The puzzle includes multiple, three-dimensional pieces which feature indicia overlapping their edges. When a three-dimensional geometric structure is correctly assembled from the pieces, completed indicia appear on all surfaces of the assembled geometric puzzle, with the portion of the indicia on each piece of the surface matching the complimentary portion of the indicia on the adjacent piece.

An object of this invention is to provide multi-polyhedral puzzles for learning about inscribed and circumscribed polyhedra, dual polyhedra and truncation of polyhedra, which puzzle is characterized by four tetrahedra and an octahedron, each assembled from a variety of polyhedron blocks.

Another object of this invention is to provide multi-polyhedral puzzles characterized by four tetrahedra and an octahedron each assembled from a corresponding set of color-matching polyhedron blocks.

Still another object of this invention is to provide multi-polyhedral puzzles including an octahedron and form tetrahedra characterized by various dissections into respective sets of polyhedron blocks, from which each tetrahedron or octahedron is solved or assembled according to one of three levels of difficulty, which typically includes color-matching of abutting block faces.

Yet another object of this invention is to provide multi-polyhedral puzzles characterized by four tetrahedra and an octahedron, each of which can be assembled from a corresponding set of polyhedron blocks in such a way as to form a prescribed color pattern on each face of the corresponding octahedron or tetrahedron for exploring various permutations and combinations.

A still further object of this invention is to provide multi-polyhedral puzzles including an octahedron and four tetrahedra which are assembled from respective sets of polyhedron blocks, each face of each block being one of multiple colors, wherein same-colored faces of adjacent polyhedron blocks in each octahedron or tetrahedron set can be placed in abutting relationship to assemble the corresponding octahedron or tetrahedron in such a manner that a prescribed color pattern is formed on each face of the octahedron or tetrahedron.

SUMMARY OF THE INVENTION

These and other objects of the invention are provided in multi-polyhedral puzzles including an octahedron and four tetrahedra, each of which is assembled from a corresponding set of polyhedron blocks, each face of each of the polyhedron blocks being one of several different colors. In a preferred embodiment each set of polyhedron blocks represents a dissection or division of the corresponding octahedron or tetrahedron which is different from that of the other sets. The octahedron and each tetrahedron are assembled from the corresponding set of polyhedron blocks inside a corresponding octahedron or tetrahedron-shaped transparent case and according to one of three levels of difficulty, the elementary level of difficulty involving assembly of the octahedron or tetrahedron irrespective of matching colors of abutting faces on adjacent polyhedron blocks. The intermediate level of difficulty involves assembly of the octahedron or tetrahedron to form a prescribed color pattern on the respective faces of the octahedron or tetrahedron, without regard to matching colors of abutting faces on adjacent polyhedron blocks. According to the advanced level of difficulty, same-colored faces of adjacent polyhedron blocks are placed in abutting relationship as the octahedron or tetrahedron is assembled inside the corresponding transparent case and a prescribed color pattern is formed on the respective faces of the octahedron or tetrahedron. The assembled tetrahedra can be arranged on respective faces of the assembled octahedron to form respective vertices of a large tetrahedron or tripyramid in which the octahedron is inscribed, for storage or packaging purposes, for example.

BRIEF DESCRIPTION OF THE DRAWINGS

The invention will be better understood by reference to the accompanying drawings, wherein.

DESCRIPTION OF THE PREFERRED EMBODIMENTS

Figure 1:
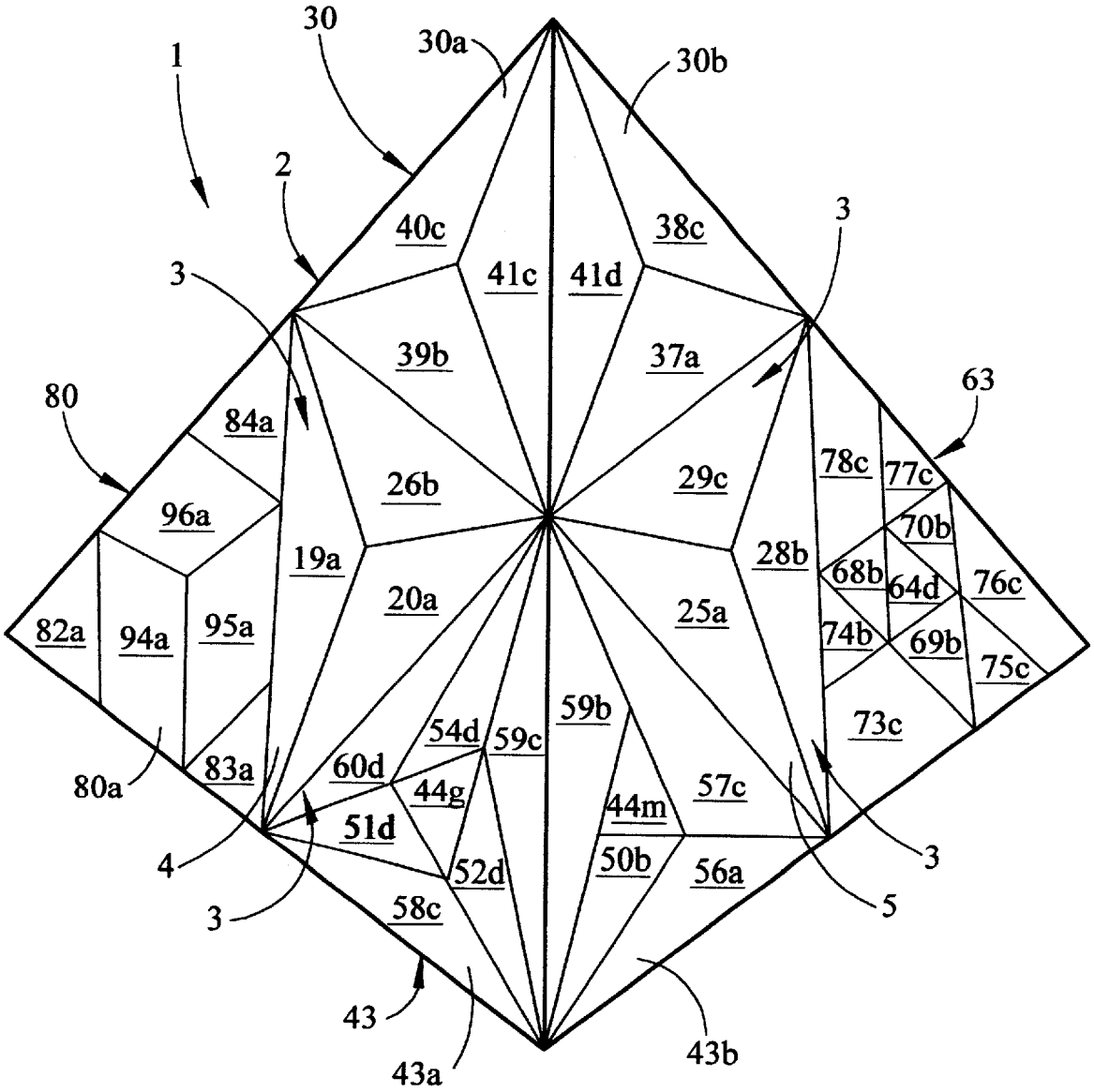
FIG. 1 is a front view of preferred embodiments of the assembled octahedron and each assembled tetrahedron of the multi-polyhedral puzzles of this invention, with the tetrahedra arranged on respective faces of the octahedron to form a large tetrahedron.
Figure 2:
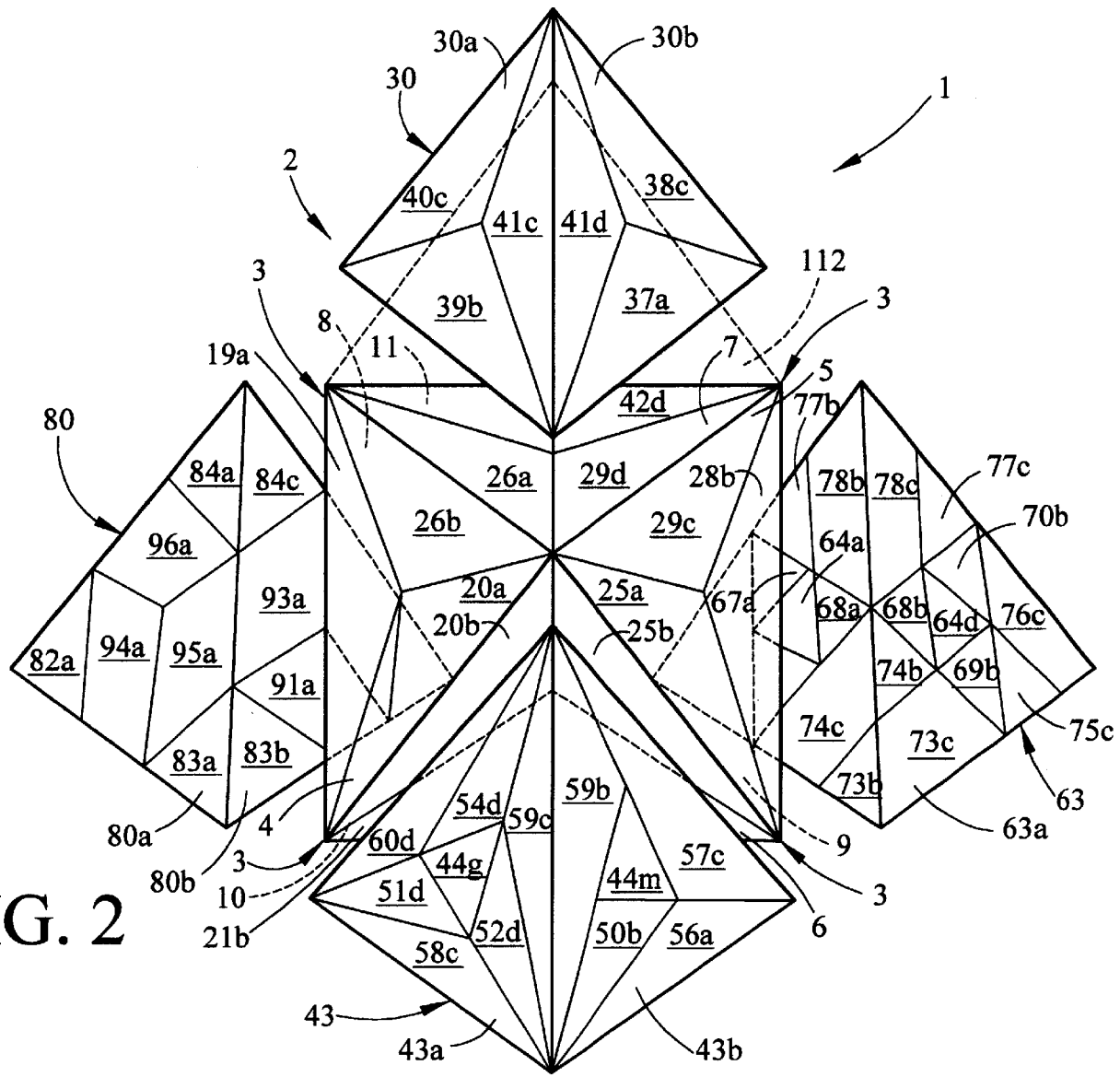
FIG. 2 is an exploded view of the multi-polyhedral puzzles illustrated in FIG. 1, with each tetrahedron component separated from the central octahedron component.

Referring initially to FIGS. 1 and 2 of the drawings, in a preferred embodiment the multi-polyhedral puzzles, hereinafter referred to as the puzzles, of this invention are collectively illustrated by reference numeral 1. As illustrated in FIGS. 1 and 2, the puzzles 1 include an octahedron 3, a regular dual tetrahedron 30, hereinafter referred to as duel tetra, a regular icosa tetrahedron 43, hereinafter icosa tetra, a regular cubocta tetrahedron 63, hereinafter cubocta tetra, and a regular truncated tetrahedron 80, hereinafter T-tetra, each assembled from a corresponding set of multiple polyhedron blocks according to one of three levels of difficulty, as hereinafter described. As illustrated in FIG. 2, the assembled octahedron 3 includes a left face 4, a right face 5, an icosa face 6 and a dual face 7 in the square pyramid facing the viewer, along with a T-face 8, a cubocta face 9, a bottom face 10 and a rear face 11, in the square pyramid facing away from the viewer, as indicated by the phantom lead lines. A selected triangular face of each assembled dual tetra 30, icosa tetra 43, cubocta tetra 63 and T-tetra 80 is typically fitted against the congruent triangular dual face 7, icosa face 6, cubocta face 9 and T-face 8, respectively, of the octahedron 3, as illustrated in FIG. 2, to form respective vertices of a large tetrahedron 2, as illustrated in FIG. 1, in order to facilitate collective packaging or efficient storage of the puzzles 1, for example. When the dual tetra 30, icosa tetra 43, cubocta tetra 63 and truncated tetra 80 are so arranged on the octahedron 3 to form the large tetrahedron 2, the left face 4, right face 5, bottom face 10 (in phantom) and rear face 11 (also in phantom) of the octahedron 3 remain exposed on the respective faces of the large tetrahedron 2, such that the octahedron 3 is inscribed in the large tetrahedron 2, as illustrated in FIG. 1.

Figure 8:
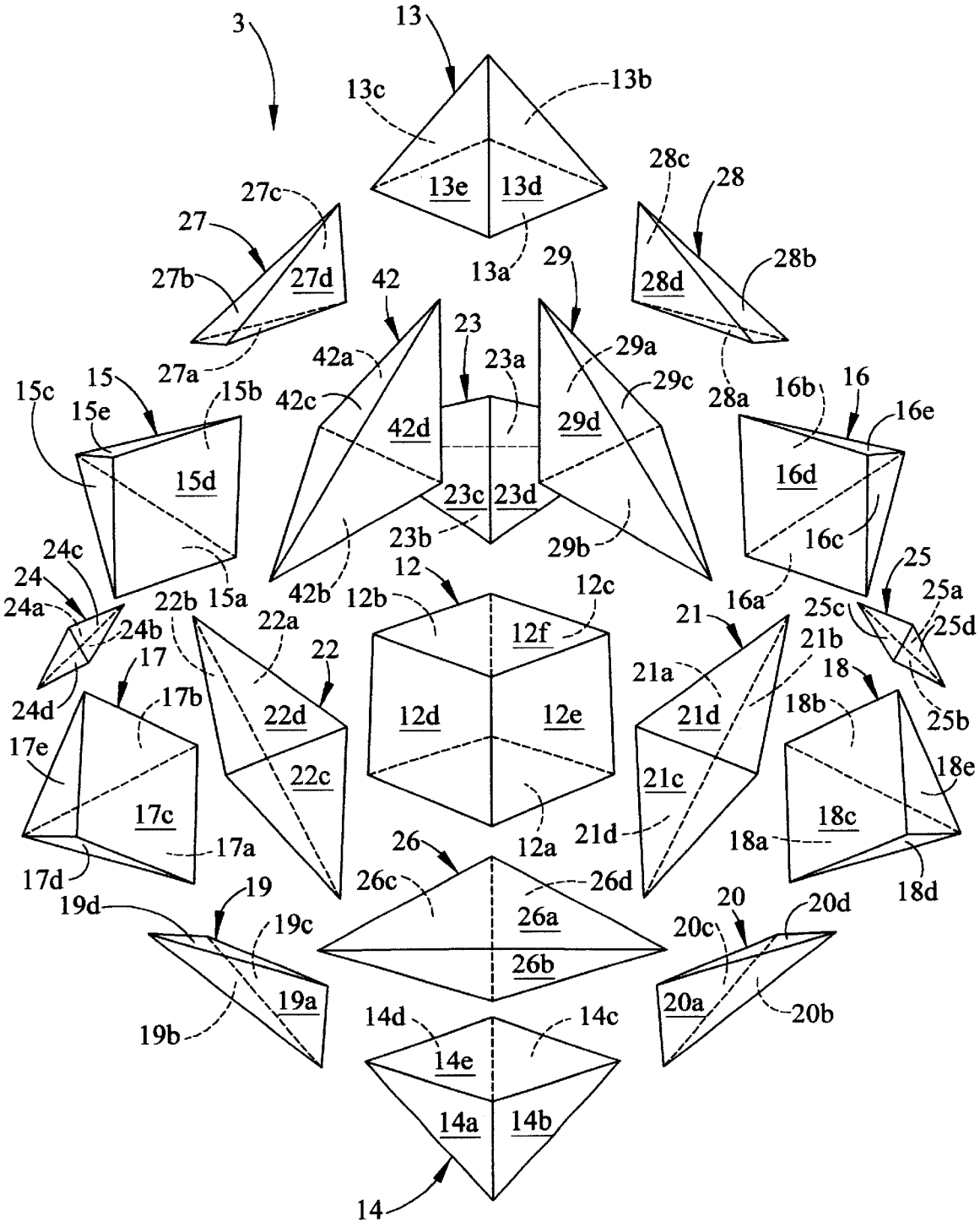
FIG. 8 is an exploded view of the octahedron of the multi-polyhedral puzzles.
Figure 8A:
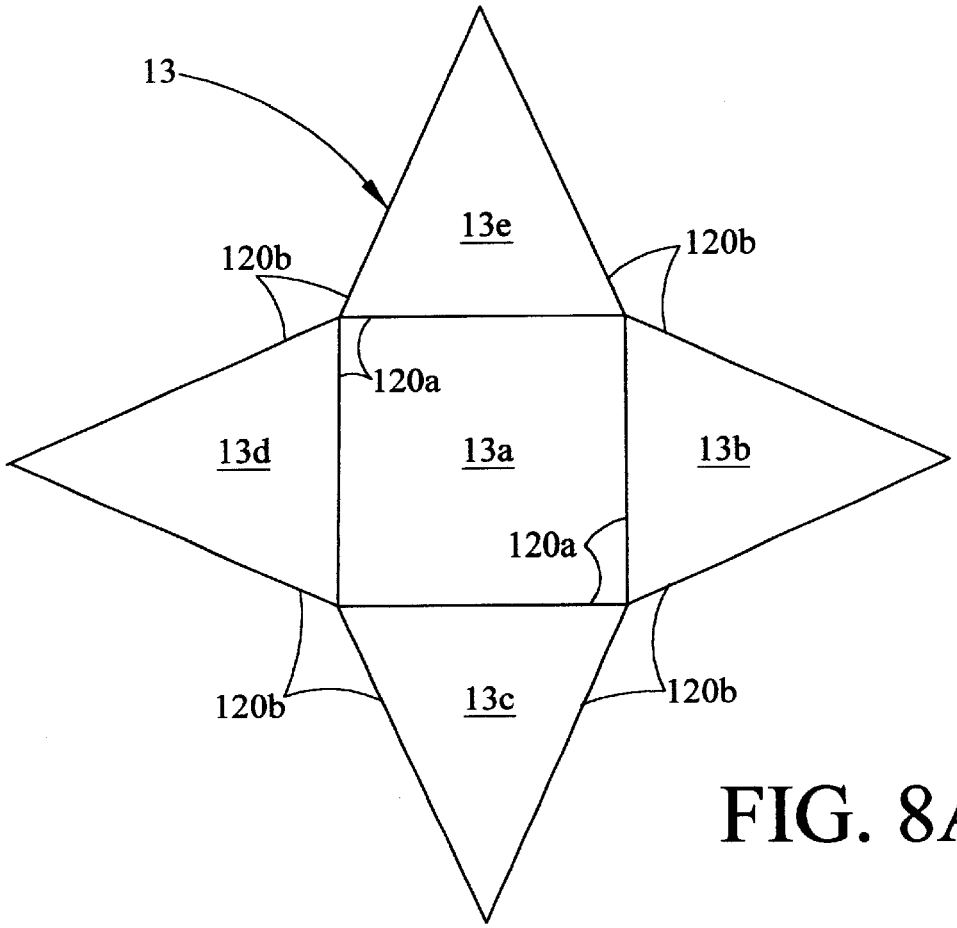
FIG. 8A is a bottom view of the unfolded, top tetrapyramid polyhedron block of the octahedron illustrated in FIG. 8.
Figure 8B:
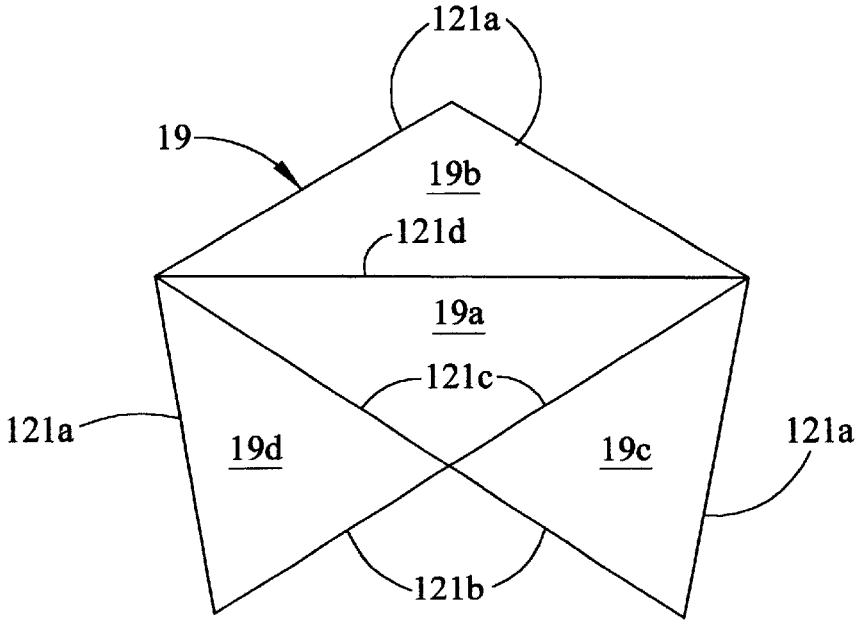
FIG. 8B is a bottom view of the unfolded, first irregular tetrahedron polyhedron block of the octahedron illustrated in FIG. 8.
Figure 8C:
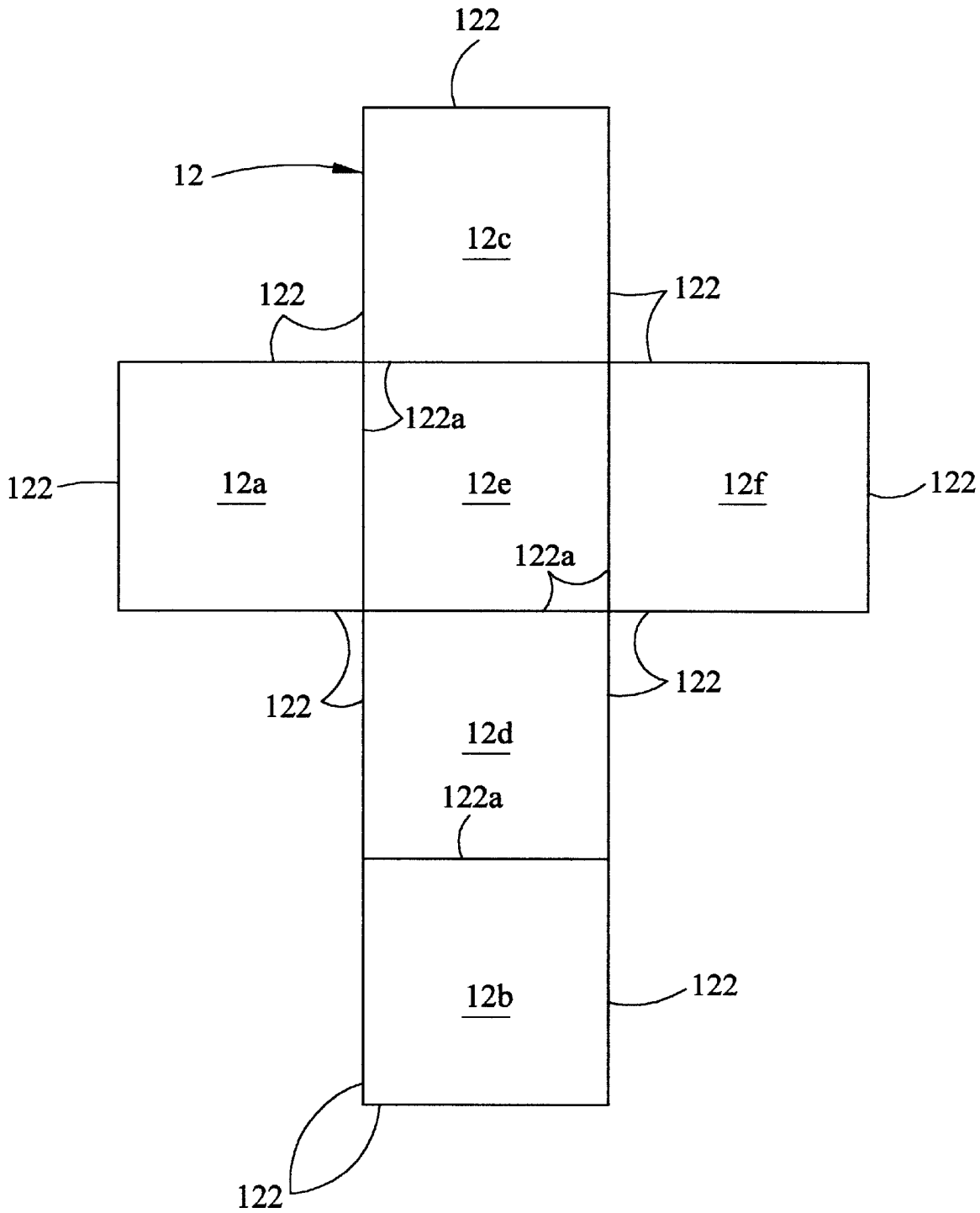
FIG. 8C is a bottom view of the unfolded, central cube polyhedron block of the octahedron illustrated in FIG. 8.
Figure 9:
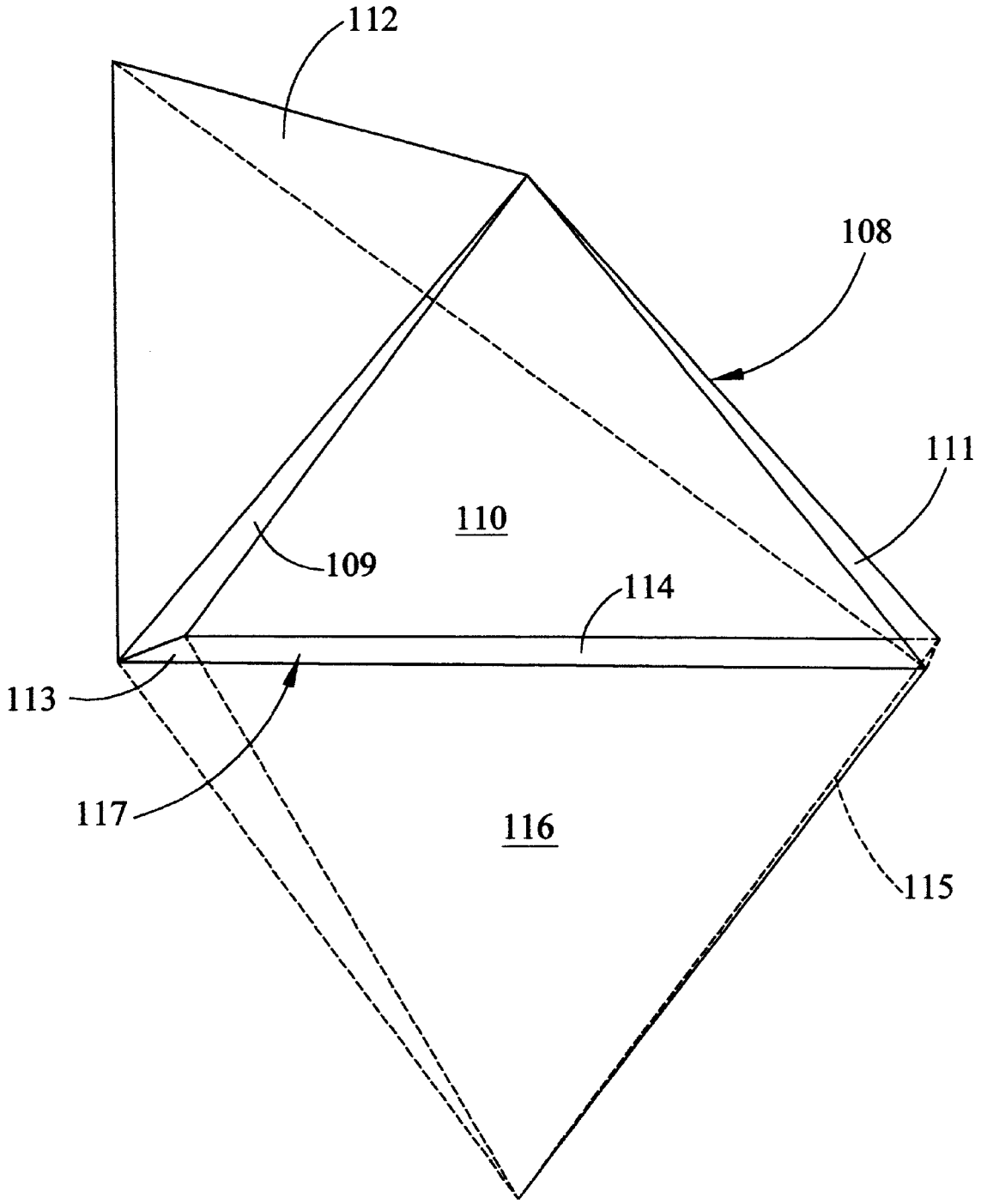
FIG. 9 is a perspective view of a t ransparent case in which the multiple polyhedron blocks of the octahedron are fitted, in assembling the octahedron in a preferred embodiment of the multi-polyhedral puzzles.

Referring next to FIGS. 8 and 8C of the drawings, the octahedron 3 is assembled from multiple polyhedron blocks, each typically constructed from paper, cardboard, wood or molded plastic and having various configurations, and each face of each polyhedron block is typically one of three colors. In a preferred embodiment the octahedron 3 is assembled inside a transparent, typically plastic octahedron case 108, as illustrated in FIG. 9. The octahedron case 108 includes a first wall 109, second wall 110, third wall 111, fourth wall 113, fifth wall 114, sixth wall 115 and seventh wall 116, defining a case interior 117. A case door 112 is hinged to the first wall 109 for reversibly closing the case interior 117. The first wall 109, second wall 110, third wall 111, fourth wall 113, fifth wall 114, sixth wall 115, seventh wall 116 and closed case door 112 define lst-8th faces, respectively, of the octahedron 3. The octahedron 3 includes a first irregular tetrahedron 19, illustrated in the unfolded configuration in FIG. 8B, and including a first face 19*a*, a second face 19*b*, a third face 19*c* and a fourth face 19*d*. The first irregular tetrahedron 19 is constructed from the unfolded configuration by folding along the fold lines 121*c* and 121*d* and matching outside edges 121*a* of the third and fourth faces 19*c* and 19*d* with the respective outside edges 121*a* of the second face 19*b* to form the first irregular tetrahedron 19 illustrated in FIG. 8. The proportion of the length of each edge of the octahedron case 108 (FIG. 9) to the length of each of the outside edges 121*a*, inside edges 121*b*, fold lines 121*c* and fold line 121*d* of the first irregular tetrahedron 19 is 1:0.5774, 1:0.4715, 1:0.5774 and 1:1, respectively. The octahedron 3 includes second, third, fourth, fifth, sixth, seventh, eighth, ninth, tenth and eleventh irregular tetrahedra, designated by reference numerals 20–29, respectively, and a twelfth irregular tetrahedron 42, each of which has the same configuration and dimensions as the first irregular tetrahedron 19 described above with respect to FIG. 8B.

The octahedron 3 further includes a top tetrapyramid 13 illustrate configuration in FIG. 8A, and including a first face 13*a*, a second face 13*b*, a third face 13*c*, a fourth face 13*d* and a fifth face 13*e*. The top tetrapyramid 13 is constructed from the unfolded configuration illustrated in FIG. 8A, by folding along the fold lines 120*a* and joining adjacent faces along the respective face edges 120*b* to form the top tetrapyramid 13 illusrated in FIG. 8. The proportion of the length of each edge of the octahedron case 108 to the length of each fold line 120*a* is 1:0.4715, whereas the proportion of the length of each edge of the tetrahedron case 101 to the length of each of the face edges 120*b* is 1:0.5774. The octahedron 3 includes a bottom tetrapyramid 14, a left rear tetrapyramid 15, a right rear tetrapyramid 16, a left front tetrapyramid 17, and a right front tetrapyramid 18, each of which has the same configuration and dimensions as the top tetrapyramid 13 described above with respect to FIG. 8A.

The octahedron 3 also includes a central cube 12 illustrated in unfolded configuration in FIG. 8C and having a first face 12*a*, a second face 12*b*, a third face 12*c*, a fourth face 12*d*, a fifth face 12*e* and a sixth face 12*f*. The central cube 12 is constructed from the unfolded configuration by folding along the fold lines 122*a* and joining the faces along the respective cube edges 122. The proportion of the length of each edge of the octahedron case 108 to the length of each of the cube edges 122 and fold lines 122*a* is 1:0.4715.

Referring again to FIGS. 1 and 2 and to FIGS. 8 and 9 of the drawings, at an advanced level of difficulty in assembling the octahedron 3 inside the octahedron case 108 and according to one of several possible methods, the first irregular tetrahedron 19 is first fitted in the case interior 117 of the open octahedron case 108, with the red first face 19*a* of the first irregular tetrahedron 19 abutting against the seventh wall 116 and the green second face 19*b* against the fourth wall 113 of the octahedron case 108. The second irregular tetrahedron 20 is next fitted in the case interior 117 in bordering relationship to the first irregular tetrahedron 19, with the green first face 20*a* of the second irregular tetrahedron 20 abutting against the seventh wall 116 and the light green second face 20*b* against the sixth wall 115 of the octahedron case 108. The third irregular tetrahedron 21 is placed in the case interior 117 in bordering relationship to the second irregular tetrahedron 20, with the red first face 21*a* of the third irregular tetrahedron 21 abutting against the fifth wall 114 and the green second face 21*b* against the sixth wall 115 of the octahedron case 108. The fourth irregular tetrahedron 22 is next fitted between and in bordering relationship to the first irregular tetrahedron 19 and third irregular tetrahedron 21, with the green first face 22*a* of the fourth irregular tetrahedron 22 resting against the fifth wall 114 and the light green second face 22*b* against the fourth wall 113 of the octahedron case 108. The inverted, bottom tetrapyramid 14 is cradled between the first irregular tetrahedron 19, second irregular tetrahedron 20, third irregular tetrahedron 21 and fourth irregular tetrahedron 22. The light green first face 14*a* of the bottom tetrapyramid 14 rests against the light green third face 19*c* of the first irregular tetrahedron 19. Furthermore, the red second face 14*b* rests against the red third face 20*c* of the second irregular tetrahedron 20, the light green third face 14*c*, against the light green third face 21*c* of the third irregular tetrahedron 21 and the red fourth face 14*d* against the red third face 22*c* of the fourth irregular tetrahedron 22. The fifth irregular tetrahedron 23 is then fitted in the case interior 117 of the octahedron case 108 in bordering relationship to said third irregular tetrahedron and said fourth irregular tetrahedron, with the red first face 23*a* abutting against the second wall 110 and the light green second face 23*b*, against the fifth wall 114, of the octahedron case 108. The left rear tetrapyramid 15 is next placed in the case interior 117, with the red first face 15*a* resting on the red fourth face 22*d* of the fourth irregular tetrahedron 22 and the green second face 15*b* abutting against the green third face 23*c* of the fifth irregular tetrahedron 23. The right rear tetrapyramid 16 is then placed in the case interior 117, with the light green first face 16*a* resting on the light green fourth face 21*d* of the third irregular tetrahedron 21 and the green second face 16*b* abutting against the green fourth face 23*d* of the fifth irregular tetrahedron 23. The sixth irregular tetrahedron 24 is next placed in the case interior 117, in bordering relationship with said first irregular tetrahedron 19 and said fourth irregular tetrahedron 22, with the light green first face 24*a* abutting against the first wall 109 and the red second face 24*b* against the fourth wall 113, of the octahedron case 108. The green third face 24*c* abuts against the green third face 15*c* of the left rear tetrapyramid 15. The seventh irregular tetrahedron 25 is then fitted in the case interior 117 in bordering relationship to said second irregular tetrahedron 20 and said third irregular tetrahedron 21, with the light green first face 25*a* abutting against the third wall 111 and the red second face 25*b* against the sixth wall 115, of the octahedron case 108. The green third face 25*c* abuts against the green third face 16*c* of the right rear tetrapyramid 16. The central cube 12 is next placed in the case interior 117, with the green first face 12*a* resting on the green fifth face 14*e* of the bottom tetrapyramid 14. The light green second face 12*b* abuts against the light green fourth face 15*d* of the left rear tetrapyramid 15 and the red third face 12*c* against the red fourth face 16*d* of the right rear tetrapyramid 16. The left front tetrapyramid 17 is then placed in the case interior 117, with the light green first face 17*a* resting on the light green fourth face 19*d* of the first irregular tetrahedron 19, the green second face 17*b* abutting against the green fourth face 24*d* of the sixth irregular tetrahedron 24 and the red third face 17*c* against the red fourth face 12*d* of the octahedron cube 12. The right front tetrapyramid 18 is next fitted in the case interior 117, with the red first face 18*a* resting on the red fourth face 20*d* of the second irregular tetrahedron 20, the green second face 18*b* abutting against the green fourth face 25*d* of the seventh irregular tetrahedron 25 and the light green third face 18*c* against the light green fifth face 12*e* of the octahedron cube 12. The eighth irregular tetrahedron 26 is fitted between the left front tetrapyramid 17 and right front tetrapyramid 18 and in bordering relationship to the first irregular tetrahedron 19 and the second irregular tetrahedron 20, with the red first face 26*a* facing the case door 112 and the light green second face 26*b* resting against the seventh wall 116 of the octahedron case 108. The green third face 26*c* abuts against the green fourth face 17*d* of the left front tetrapyramid 17 and the green fourth face 26*d* against the green fourth face 18*d* of the right front tetrapyramid 18. The ninth irregular tetrahedron 27 is next placed in the case interior 117 in bordering relationship to said fifth irregular tetrahedron 23 and said sixth irregular tetrahedron 24, with the red first face 27*a* resting on the red fifth face 15*e* of the left rear tetrapyramid 15 and the green second face 27*b* abutting against the first wall 109 and the light green third face 27*c* against the second wall 110 of the octahedron case 108. The tenth irregular tetrahedron 28 is next placed in the case interior 117 in bordering relationship to the fifth irregular tetrahedron 23, the seventh irregular tetrahedron 25 and the ninth irregular tetrahedron 27, with the light green first face 28*a* resting on the light green fifth face 16*e* of the right rear tetrapyramid 16. The red second face 28*b* abuts against the third wall 111 and the green third face 28*c* against the second wall 110 of the octahedron case 108. The top tetrapyramid 13 is then fitted inside the case interior 117, with the green first face 13*a* resting on the green sixth face 12*f* of the central octahedron cube 12. The light green second face 13*b* abuts against the light green fourth face 28*d* of the tenth irregular tetrahedron 28 and the red third face 13*c*, against the red fourth face 27*d* of the ninth irregular tetrahedron 27. The eleventh irregular tetrahedron 29 is next fitted in the case interior 117 in bordering relationship to the seventh irregular tetrahedron 25, the eighth irregular tetrahedron 26 and the tenth irregular tetrahedron 28 with the red first face 29*a* resting against the red fourth face 13*d* of the top tetrapyramid 13 and the red second face 29*b* against the red fifth face 18*e* of the right front tetrapyramid 18. The green third face 29*c* abuts against the third wall 111 and the light green fourth face 29*d* faces the case door 112 of the octahedron case 108. To complete assembly of the octahedron 3 in the tetrahedron case 101, the twelfth irregular tetrahedron 42 is fitted in the remaining space in case interior of 117 in bordering relationship to the sixth irregular tetrahedron 24, the eighth irregular tetrahedron 26, the ninth irregular tetrahedron 27 and the eleventh irregular tetrahedron 29, with the light green first face 42*a* resting against the light green fifth face 13*e* of the top tetrapyramid 13 and the light green second face 42*b* resting on the light green fifth face 17*e* of the left front tetrapyramid 17. The red third face 42*c* abuts against the first wall 109 and the green fourth face 42*d* faces the case door 112 of the octahedron case 108. Finally, the case door 112 of the polyhedron case 108 is closed against the red first face 26*a* of the eighth irregular tetrahedron 26, the light green fourth face 29*d* of the eleventh irregular tetrahedron 29 and the green fourth face 42*d* of the twelfth irregular tetrahedron 42. When the polyhedron blocks are so arranged in the assembled octahedron 3 in the octahedron case 108, each triangular face of the octahedron 3 is bounded by a green face of one irregular tetrahedron, a red face of another irregular tetrahedron and a light green face of still another irregular tetrahedron. For example, referring again to FIG. 2 of the drawings, when the top or dual face 7 of the large octahedron 3 corresponds to the case door 112 of the octahedron case 108, the left face 4 of the octahedron 3, corresponding to the seventh wall 116 of the octahedron case 108, is bounded by the light green second face 26*b* of the eighth irregular tetrahedron 26, the green first face 20*a* of the second irregular tetrahedron 20 and the red first face 19*a* of the first irregular tetrahedron 19. Likewise, the right face 5 of the octahedron 3, corresponding to the third wall 111 of the octahedron case 108, is bounded by the light green first face 25*a* of the seventh irregular tetrahedron 25, the red second face 28*b* of the tenth irregular tetrahedron 28 and the green third face 29*c* of the eleventh irregular tetrahedron 29. It will be appreciated by those skilled in the art that the foregoing description involves an advanced level of difficulty in assembling the octahedron 3 in the octahedron case 108, by matching colors of abutting, congruent faces of adjacent polyhedron blocks in the puzzle. At an intermediate level of difficulty in assembling the octahedron 3, the polyhedron blocks are assembled in the octahedron case 108 to form the three-color pattern on each face of the octahedron 3, but without regard to matching colors of abutting congruent faces of adjacent polyhedron blocks. At an elementary level of difficulty in assembling the octahedron 3, the polyhedron blocks are assembled in the octahedron case 108 without regard to matching colors of abutting, congruent faces of adjacent polyhedron blocks or formation of the three-color pattern on each face of the octahedron 3. It is understood that each color on the respective faces of each polyhedron block can be substituted by one of three different colors other than green, light green and red, as described above, with the same color on different faces substituted by the same color. In that case, matching colors of abutting faces on adjacent polyhedron blocks according to the advanced level of difficulty described above would provide the same degree of difficulty in assembling the octahedron 3, as well as the prescribed color pattern formation on each face of the octahedron 3.

Figure 3:
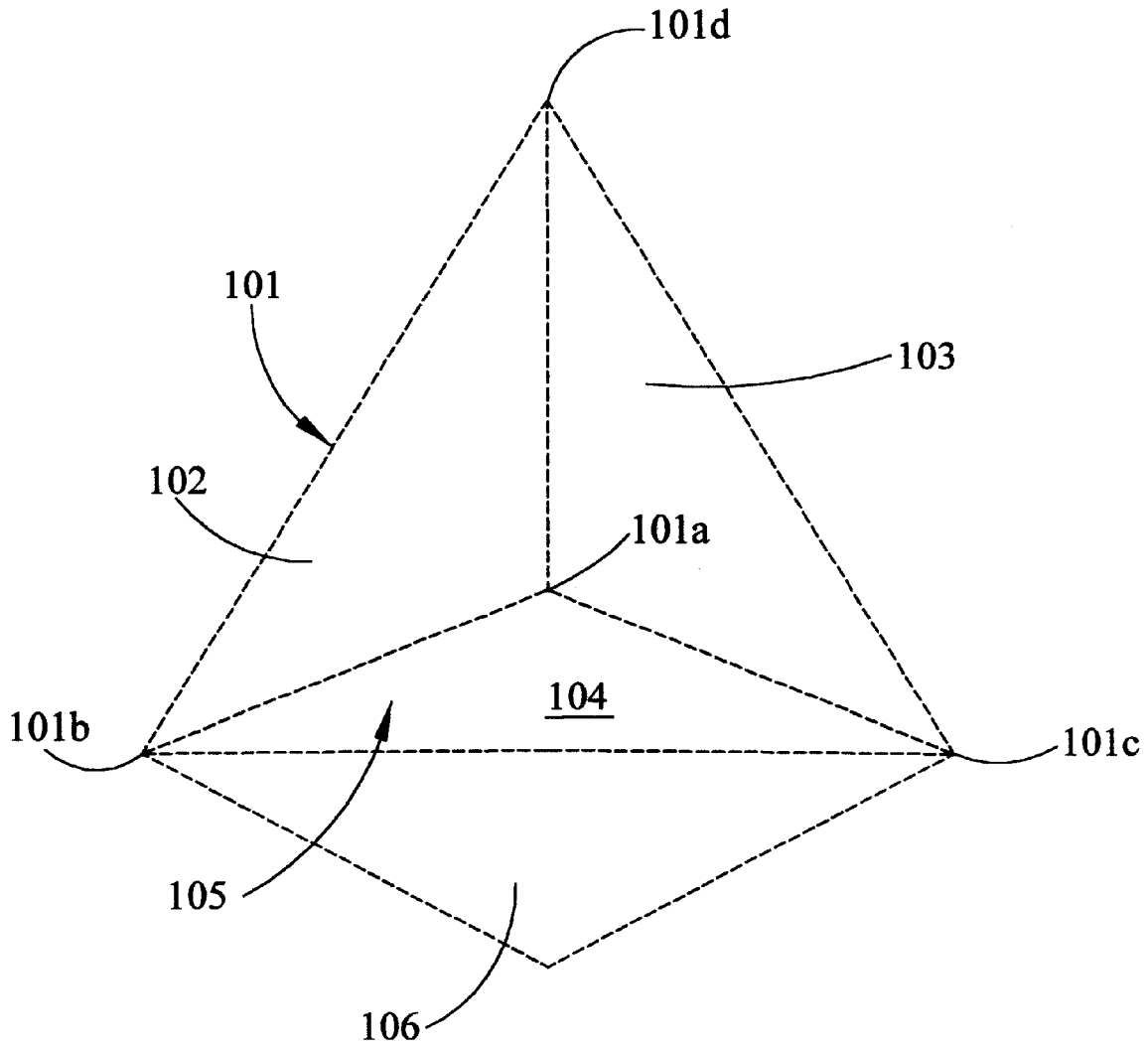
FIG. 3 is a front view of a transparent case in which the multiple polyhedron blocks of each tetrahedron are fitted in assembling each tetrahedron in preferred embodiments of the multipolyhedral puzzles.
Figure 4:
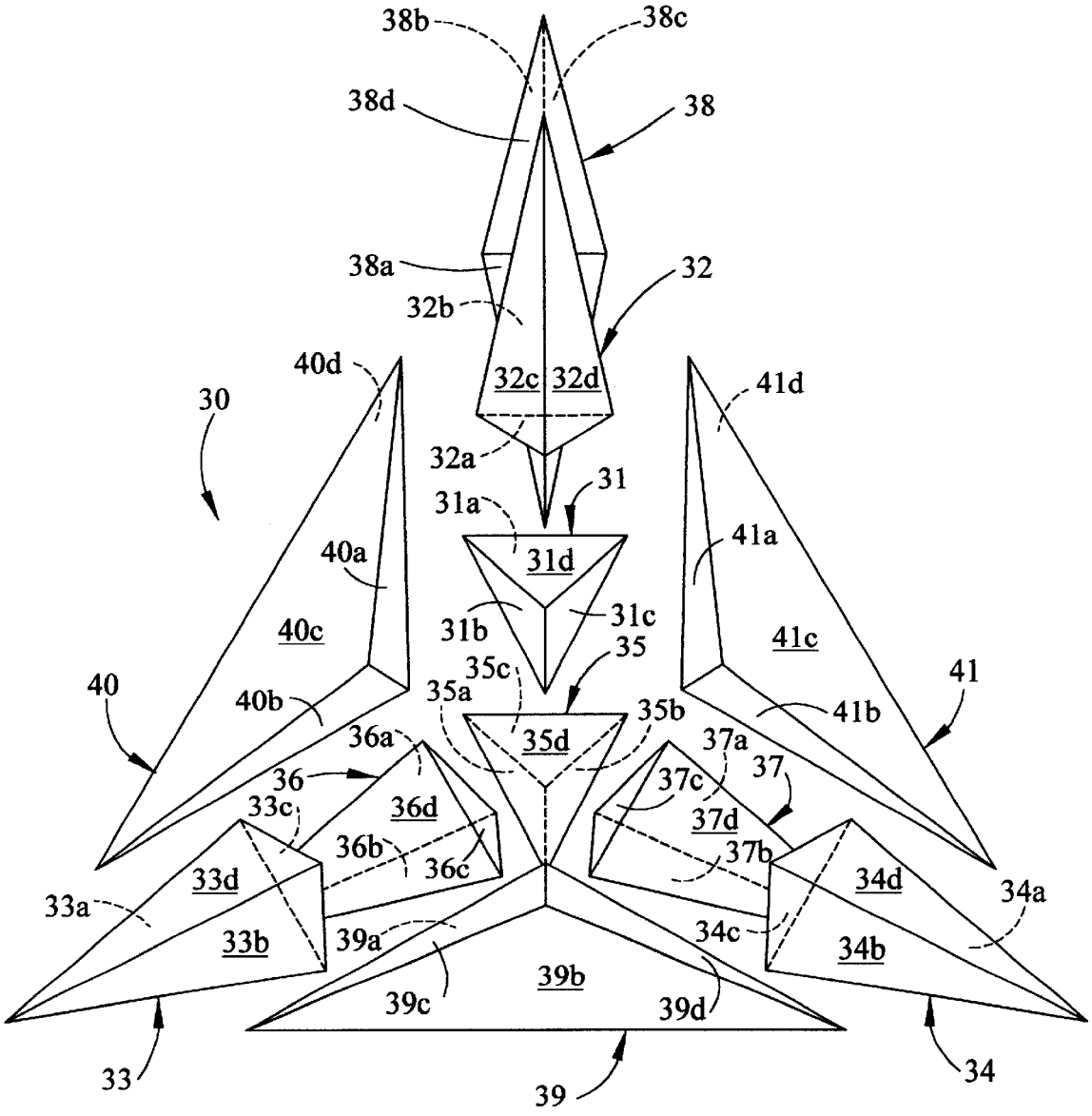
FIG. 4 is an exploded view of a dual tetrahedron of the multi-polyhedral puzzles.
Figure 4A:
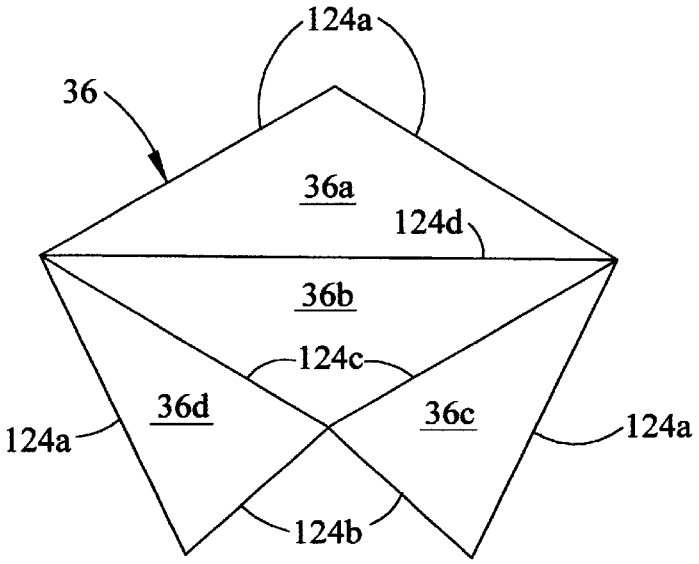
FIG. 4A is a bottom view of an unfolded, first irregular, large tetrahedron polyhedron block of the dual tetra illustrated in FIG. 4.
Figure 4B:
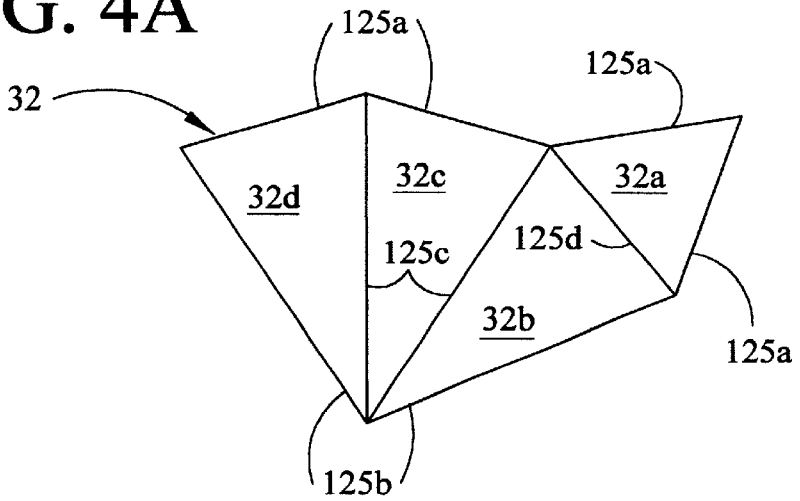
FIG. 4B is a bottom view of an unfolded, top tripyramid polyhedron block of the dual tetra.
Figure 4C:
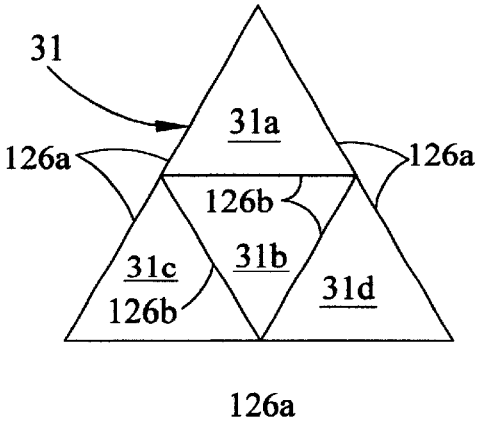
FIG. 4C is a bottom view of an unfolded, regular tetrahedron polyhedron block of the dual tetra.

Referring now to FIGS. 3 and particularly to FIGS. 4–4C of the drawings, in a preferred embodiment the dual tetra 30 is assembled inside a transparent, typically plastic, pyramidal tetrahedron case 101, illustrated in phantom. The tetrahedron case 101 has four vertices 101*a* and includes a left wall 102, a right wall 103 and a bottom wall 104 defining a case interior 105, with a case door 106 hinged to the bottom wall 104 for reversibly closing the case interior 105, as illustrated in FIG. 3. The dual tetra 30 includes a first irregular, large tetrahedron 36 illustrated in unfolded configuration in FIG. 4A and including a first face 36*a*, second face 36*b*, third face 36*c* and fourth face 36*d*. The first irregular, large tetrahedron 36 is constructed from the unfolded configuration illustrated in FIG. 4A, by folding along the fold lines 124*c* and 124*d* and matching outside edges 124*a* of the third and fourth faces 36*c* and 36*d*, respectively, with the respective outside edges 124*a* of the first face 36*a*. The proportion of the length of each edge of the tetrahedron case 101 (FIG. 3) to the length of each of the outside edges 124*a*, inside edges 124*b*, fold lines 124*c* and fold line 124*d*, is 1:0.5774, 1:0.3333, 1:0.5774 and 1:1, respectively. The dual tetra 30 includes second, third, fourth, fifth and sixth irregular, large tetrahedron, designated by reference numerals 37–41, respectively, in FIG. 4, each of which has the same configuration and dimensions as the first irregular, large tetrahedron 36 described above with respect to FIG. 4A. The dual tetra 30 further includes a top tripyramid 32, illustrated in the unfolded configuration in FIG. 4B and including a first face 32*a*, a second face 32*b*, a third face 32*c* and a fourth face 32*d*. The top tripyramid 32 is constructed from the unfolded configuration illustrated in FIG. 4B, by folding along the fold lines 125*c* and base fold line 125*d*, and joining the respective base edges 125*a* and the face edges 125*b*. The proportion of the length of each edge of the tetrahedron case 101 to the length of each base edge 125*a*, face edge 125*b*, fold lines 125*c* and base fold line 125*d*, is 1:0.3333, 1:0.5774, 1:0.5774 and 1:0.3333, respectively. The dual tetra 30 includes a left tripyramid 33, a right tripyramid 34 and a rear tripyramid 35, each of which has the same configuration and dimensions as the top tripyramid 32 described above with respect to FIG. 4B. The dual tetra 30 further includes a regular tetrahedron, illustrated in the unfolded configuration in FIG. 4C and having a first face 31*a*, a second face 31*b*, a third face 31*c* and a fourth face 31*d*. The regular tetrahedron 31 is constructed from the unfolded configuration illustrated in FIG. 4C, by folding along the fold lines 126*b* and joining the adjacent face edges 126*a*. The proportion of the length of each edge of the tetrahedron case 101 to the length of each face edge 126*a* and each fold line 126*b* is 1:0.3333.

Referring again to FIGS. 1 and 2 and particularly to FIGS. 3 and 4 of the drawings, at an advanced level of difficulty an advanced level of difficulty in assembling the dual tetra 30 in the tetrahedron case 101 according to one of several possible methods, the first irregular, large tetrahedron 36 is initially placed in the case interior 105 of the open tetrahedron case 101, with the red first face 36*a* abutting against the left wall 102 and the green second face 36*b* resting on the bottom wall 104 of the tetrahedron case 101. The second irregular, large tetrahedron 37 is next fitted in the case interior 105, with the purple first face 37*a* abutting against the right wall 103 and the green second face 37*b* resting on the bottom wall 104 of the tetrahedron case 101. The rear tripyramid 35 is next inserted between the first irregular, large tetrahedron 36 and the second irregular, large tetrahedron 37, with the purple first face 35*a* resting against the purple third face 36*c* of the first irregular, large tetrahedron 36 and the red second face 35*b*, against the red third face 37*c* of the second irregular, large tetrahedron 37. The third irregular, large tetrahedron 38 is next fitted in the case interior 105, with the green first face 38*a* resting on the green third face 35*c* of the rear tripyramid 35. The red second face 38*b* abuts against the left wall 102 and the purple third face 38*c* against the right wall 103 of the tetrahedron case 101. The fourth irregular, large tetrahedron 39 is next placed between the first irregular, large tetrahedron 36 and second irregular, large tetrahedron 37, such that the green first face 39*a* of the fourth irregular, large tetrahedron 39 rests on the bottom wall 104 and the blue second face 39*b* faces the case door 106 of the tetrahedron case 101. The left tripyramid 33 is then fitted between the first irregular, large tetrahedron 36 and fourth irregular, large tetrahedron 39, such that the blue first face 33*a* abuts against the blue fourth face 36*d* of the first irregular, large tetrahedron 36, and the red second face 33*b* against the red third face 39*c* of the fourth irregular, large tetrahedron 39. The right tripyramid 34 is next fitted between the second irregular, large tetrahedron 37 and fourth irregular, large tetrahedron 39, such that the blue first face 34*a* rests against the blue fourth face 37*d* of the second irregular, large tetrahedron 37 and the purple second face 34*b* against the purple fourth face 39*d* of the fourth irregular, large tetrahedron 39. The regular tetrahedron 31 is then placed in the case interior 105, such that the blue rear or first face 31*a* abuts against the blue fourth face 35*d* of the rear tripyramid 35, the purple second face 31*b* against the purple third face 33*c* of the left tripyramid 33 and the red third face 31*c* against the red third face 34*c* of the right tripyramid 34. The top tripyramid 32 is next placed in the case interior 105, with the green bottom or first face 32*a* resting on the green fourth face 31*d* of the regular tetrahedron 31 and the blue second or rear face 32*b* against the blue fourth face 38*d* of the third irregular, large tetrahedron 38. The fifth irregular, large tetrahedron 40 is next placed in the case interior 105, with the purple first face 40*a* abutting against the purple third face 32*c* of the top tripyramid 32 and the green second face 40*b* resting on the green fourth face 33*d* of the left tripyramid 33. The blue third face 40*c* faces the case door 106 and the red fourth face 40*d* abuts against the left wall 102 of the tetrahedron case 101. Finally, to complete assembly of the dual small tetrahedron 30, the sixth irregular, large tetrahedron 41 is fitted in the remaining space in the case interior 105, with the red first face 41*a* abutting against the red fourth face 32*d* of the top tripyramid 32 and the green second face 41*b* resting on the green fourth face 34*d* of the right tripyramid 34. The blue third face 41*c* faces the case door 106 and the purple fourth face 41*d* abuts against the right wall 103 of the tetrahedron case 101. Finally, the case door 106 of the tetrahedron case 101 is closed against the blue second face 39*b* of the fourth irregular, large tetrahedron 39, the blue third face 40*c* of the fifth irregular, large tetrahedron 40 and the blue third face 41*c* of the sixth irregular, large tetrahedron 41.

As illustrated in FIGS. 1 and 2 of the drawings, when the polyhedron blocks are assembled into the dual tetra 30 in the tetrahedron case 101 according to the foregoing description, each face of the dual tetra 30 is the same color. For example, as described above, the blue third face 40*c* of the fifth irregular, large tetrahedron 40, the blue third face 41*c* of the sixth irregular, large tetrahedron 41 and the blue second face 39*b* of the fourth irregular, large tetrahedron 39 combine to form a front face 30*a* of the dual tetra 30 corresponding to the closed case door 106 of the tetrahedron case 101, which is blue in color. In similar fashion, the purple fourth face 41*d* of the sixth irregular, large tetrahedron 41, the purple fourth face 38*c* of the third irregular, large tetrahedron 38 and the purple first face 37*a* of the second irregular, large tetrahedron 37, combine to form a right face 30*b* of the dual tetra 30, which is purple in color and corresponds to the right wall 103 of the tetrahedron case 101. As with the description of assembling the octahedron 3 set forth above, the foregoing description involves an advanced or difficult level of assembling the dual tetra 30 from the constituent polyhedron blocks. At an intermediate level of difficulty in assembling the dual tetra 30, the polyhedron blocks are assembled in the tetrahedron case 101 to form the uniform color pattern on each face of the dual tetra 30, but without regard to matching colors of abutting faces of adjacent polyhedron blocks. At an elementary level of assembling the dual tetra 30, the polyhedron blocks are fitted in the tetrahedron case 101 in the same orientations described above, although without regard to matching colors of abutting faces on adjacent polyhedron blocks or uniform color formation on each face of the dual tetra 30. It is understood that each color on the respective faces of each polyhedron block can be substituted by one of four different colors other than red, blue, purple and green, as described above, with the same color on different faces substituted by the same color. Accordingly, matching colors of abutting faces on adjacent polyhedron blocks according to the advanced level of difficulty described above would provide the same degree of difficulty in assembling the dual tetra 30, as well as a uniform color pattern formation on each face of the dual tetra 30.

Figure 5:
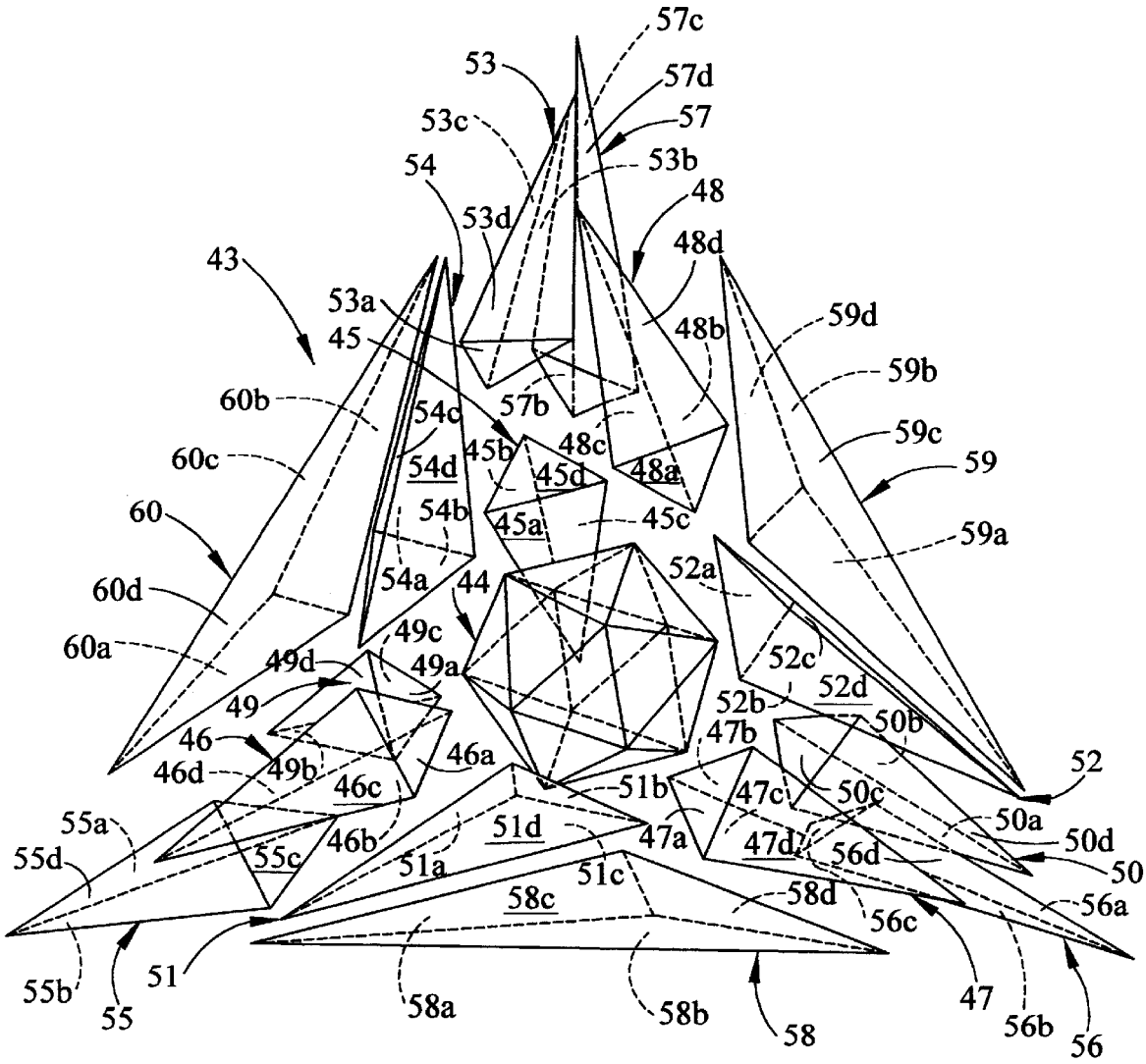
FIG. 5 is an exploded view of an icosa tetrahedron component of the multi-polyhedral puzzles.
Figure 5A:
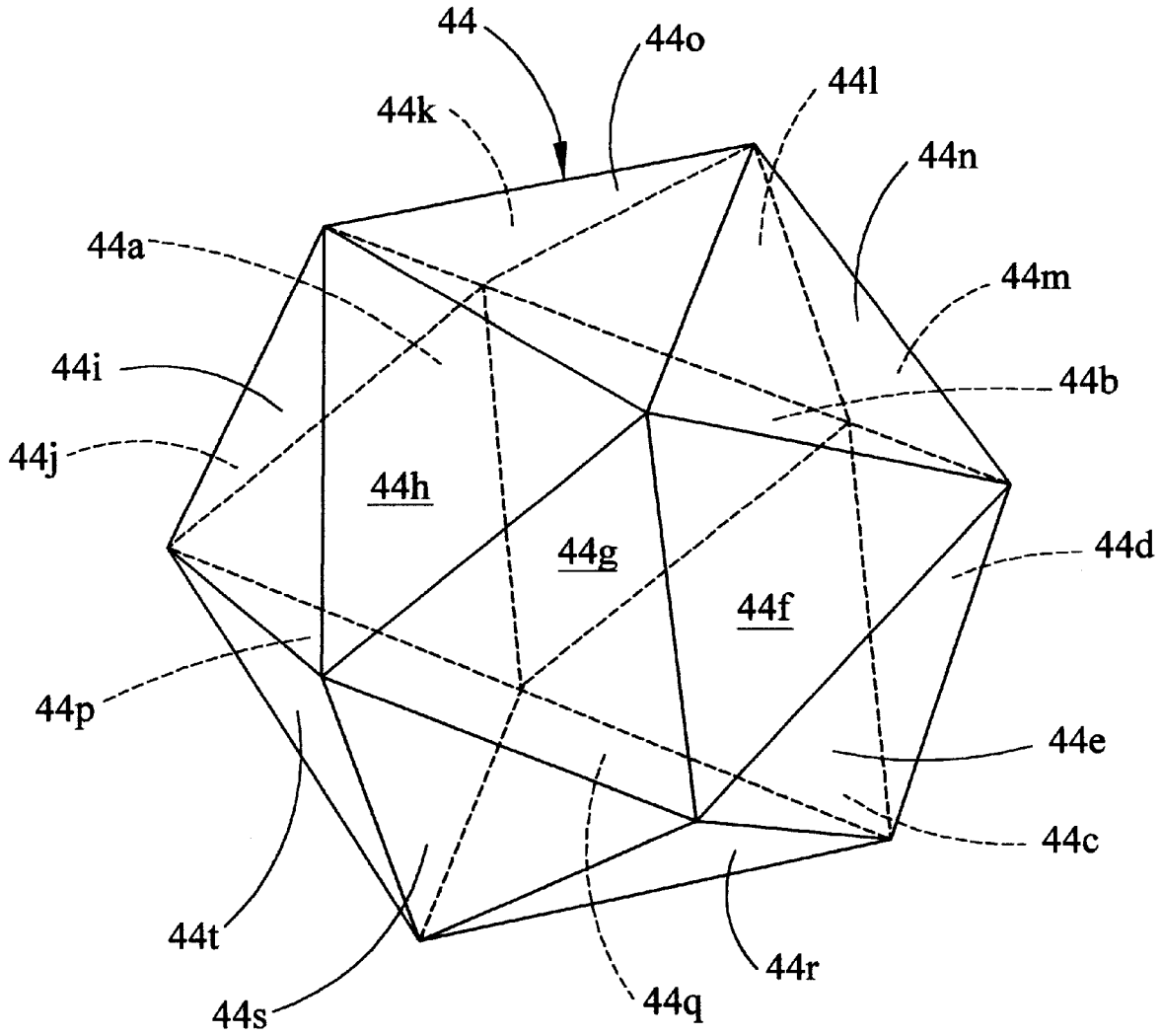
FIG. 5A is a central, icosahedral polyhedron block of the icosa tetrahedron illustrated in FIG. 5.
Figure 5B:
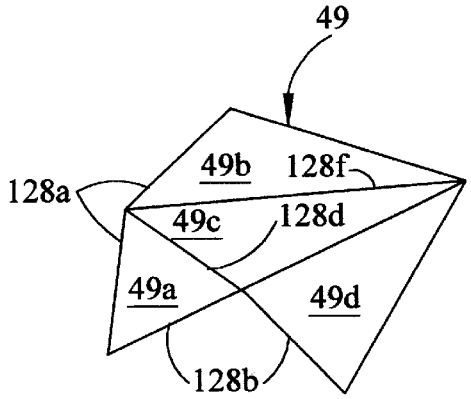
FIG. 5B is a bottom view of an unfolded, first small tetrahedron polyhedron block of the icosa tetrahedron.
Figure 5C:
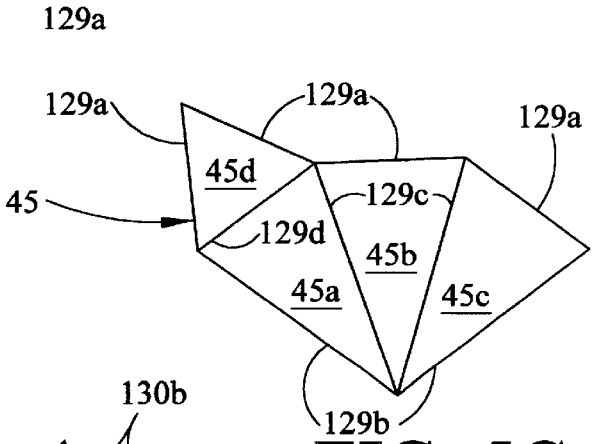
FIG. 5C is a bottom view of an unfolded, first icosa pyramid polyhedron block of the icosa tetrahedron.
Figure 5D:
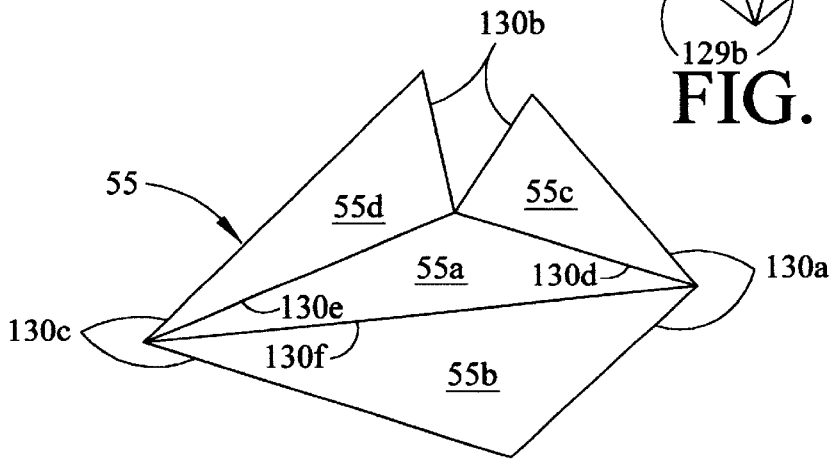
FIG. 5D is a bottom view of an unfolded, first large tetrahedron polyhedron block of the icosa tetrahedron.
Figure 5E:
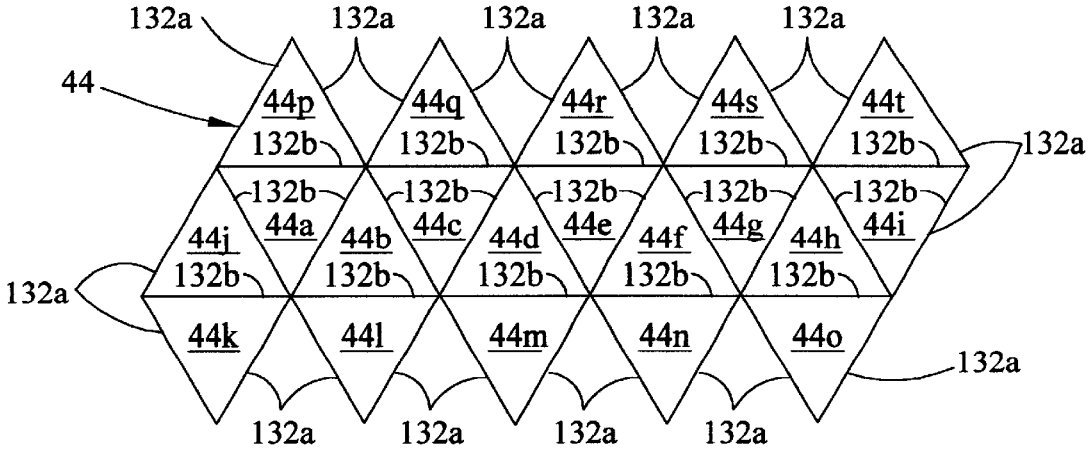
FIG. 5E is a bottom view of an unfolded, icosahedron polyhedron block of the icosa tetrahedron.

Referring next to FIGS. 5–5E of the drawings, the icosa tetra 43 is assembled from multiple polyhedron blocks in a second tetrahedron case 101 (FIG. 2) according to an advanced, intermediate or elementary level of difficulty, as hereinafter described. The icosa tetra 43 includes a first small tetrahedron 49, illustrated in the unfolded configuration in FIG. 5B and including a first face 49*a*, a second face 49*b*, a third face 49*c* and a fourth face 49*d*. The first small tetrahedron 49 is constructed from the unfolded configuration illustrated in FIG. 5B, by folding along the front fold line 128*d* and longitudinal fold line 128*f* and joining the front edges 128*a*, and folding along the rear fold line 128*e* and joining the rear edges 128*c* and inside edges 128*b*. The proportion of the length of each edge of the tetrahedron case 101 to the length of each of the front edges 128*a*, the inside edges 128*b*, the rear edges 128*c*, the front fold line 128*d*, the rear fold line 128*e* and the longitudinal fold line 128*f*, is 1:0.25, 1:0.25, 1:0.45, 1:0.25, 1:0.45 and 1:1, respectively. The icosa tetra 43 includes a first small tetrahedron 49, a second small tetrahedron 50, a third small tetrahedron 51, a fourth small tetrahedron 52, a fifth small tetrahedron 53 and a sixth small tetrahedron 54, each of which has the same configuration and dimensions as the first small tetrahedron 49 described above with respect to FIG. 5B. The icosa tetra 43 includes a first icosa pyramid 45, illustrated in the unfolded configuration in FIG. 5C and having a first face 45*a*, a second face 45*b*, a third face 45*c* and a fourth face 45*d*. The first icosa pyramid 45 is constructed from the unfolded configuration by folding along the fold lines 129*c* and base fold line 129*d*, and joining the base edges 129*a* and face edges 129*b*. The proportion of the length of each edge of the tetrahedron case 101 to the length of each of the base edges 129*a*, the face edges 129*b*, the fold lines 129*c* and base fold line 129*d*, is 1:0.25, 1:0.45, 1:0.45 and 1:0.25, respectively. The icosa tetra 43 includes a second icosa pyramid 46, a third icosa pyramid 47 and a fourth icosa pyramid 48, each of which has the same configuration and dimensions as the first icosa pyramid 45 described above with respect to FIG. 5*c*.

The icosa tetra 43 further includes a first large tetrahedron 55, illustrated in the unfolded configuration in FIG. 5D and having a first face 55*a*, a second face 55*b*, a third face 55*c* and a fourth face 55*d*. The first large tetrahedron 55 is constructed from the unfolded configuration by folding along the front fold line 130*d* and longitudinal fold line 130*f* and joining the front edges 130*a* and folding along the rear fold line 130*e* and joining the rear edges 130*c* and inside edges 130*b*. The proportion of the length of each edge of the tetrahedron case 101 to the length of each of the front edges 130*a*, inside edges 130*b*, rear edges 130*c*, front fold line 130*d*, rear fold line 130*e* and longitudinal fold line 130*f*, is 1:0.45, 1:0.25, 1:0.7, 1:0.45, 1:0.61 and 1:1, respectively. The icosa tetra 43 includes a second large tetrahedron 56, a third large tetrahedron 57, a fourth large tetrahedron 58, a fifth large tetrahedron 59 and a sixth large tetrahedron 60, each of which has the same configuration and dimensions as the first large tetrahedron 55 described above with respect to FIG. 5D. The icosa tetra 43 includes an icosahedron 44, illustrated in the unfolded configuration in FIG. 5E and having twenty faces, designated by reference numerals 44*a*–44*t*, respectively. The icosahedron 44 is constructed from the unfolded configuration by folding along the fold lines 132*b* and joining the respective face edges 132*a*, according to the knowledge of those skilled in the art. The proportion of the length of each edge of the tetrahedron case 101 to the length of each of the face edges 132*a* and fold lines 132*b*, is 1:0.25.

Referring again to FIGS. 1–3 and particularly to FIG. 5 of the drawings, in assembling the icosa tetra 43 from multiple polyhedron blocks in a second tetrahedron case 101, at an advanced level of difficulty and according to one of several possible methods, the first large tetrahedron 55 is initially placed in the case interior 105 of the open tetrahedron case 101, with the blue first face 55*a* abutting against the left wall 102 and the light green second face 55*b* resting on the bottom wall 104 of the tetrahedron case 101. The second large tetrahedron 56 is then placed in the case interior 105, with the orange first face 56*a* abutting against the right wall 103 and the light green second face 56*b* resting on the bottom wall 104 of the tetrahedron case 101. The first icosa pyramid 45 is next placed in the case interior 105, with the blue first face 45*a* resting against the blue third face 56*c* of the second large tetrahedron 56. The first small tetrahedron 49 is next placed in the case interior 105, with the orange first face 49*a* resting against the orange second face 45*b* of the first icosa pyramid 45, the yellow second face 49*b* resting on the yellow third face 55*c* of the first large tetrahedron 55 and the light green third face 49*c* abutting against the left wall 102 of the tetrahedron case 101. The third large tetrahedron 57 is then fitted in the case interior 105, with the yellow first face 57*a* resting on the yellow third face 45*c* of the first icosa pyramid 45. The blue second face 57*b* of the third large tetrahedron 57 abuts against the left wall 102 and the orange third face 57*c* against the right wall 103 of the tetrahedron case 101. The second small tetrahedron 50 is next fitted in the case interior 105, with the blue first face 50*a* resting on the blue fourth face 56*d* of the second large tetrahedron 56 and the yellow second face 50*b* of the second small tetrahedron 50 abutting against the right wall 103 of the tetrahedron case 101. The icosahedron 44, illustrated in FIG. 5*a*, is then fitted in the case interior 105, with the orange first face 44*a* abutting against the orange fourth face 49*d* of the first small tetrahedron 49, the light green second face 44*b* against the light green fourth face 45*d* of the first icosa pyramid 45, the blue third face 44*c* against the blue fourth face 56*d* of the second large tetrahedron 56, the orange fourth face 44*d* against the orange third face 50*c* of the second small tetrahedron 50 and the yellow sixteenth face 44*p* resting against the yellow third face 55*c* of the first large tetrahedron 55. When the icosahedron 44 is so fitted in the tetrahedron case 101, the icosahedron 44 is inscribed in the icosa tetra 43 with the red seventh face 44*g* facing the case door 106, the red tenth face 44*j* abutting against the left wall 102, the red thirteenth face 44*m*, against the right wall 103 and the red seventeenth face 44*q* resting on the bottom wall 104, of the tetrahedron case 101. The second icosa pyramid 46 is next fitted in the case interior 105, with the blue first face 46*a* abutting against the blue twentieth face 44*t* of the icosahedron 44 and the yellow second face 46*b* against the yellow fourth face 55*d* of the first large tetrahedron 55. The fourth large tetrahedron 58 is next placed in the case interior 105, with the light green first face 58*a* abutting against the light green eighteenth face 44*r* of the icosahedron 44. The light green second face 58*b* rests on the bottom wall 104 and the yellow third face 58*c* faces the case door 106 of the tetrahedron case 101. The third icosa pyramid 47 is then fitted in the case interior 105, with the yellow first face 47*a* abutting against the yellow fifth face 44*e* of the icosahedron 44, the orange second face 47*b* against the orange fourth face 50*d* of the second small tetrahedron 50 and the light green third face 47*c* against the light green fourth face 58*d* of the fourth large tetrahedron 58. The third small tetrahedron 51 is next inserted between the second icosa pyramid 46 and fourth large tetrahedron 58, with the orange first face 51*a* abutting against the orange third face 46*c* of the second icosa pyramid 46, the orange second face 51*b* abutting against the orange nineteenth face 44*s* of the icosahedron 44 and the light green third face 51*c* resting on the light green first face 58*a* of the fourth large tetrahedron 58. The blue fourth face 51*d* faces the case door 106 of the tetrahedron case 101. The fifth large tetrahedron 59 is next placed in the case interior 105, with the light green first face 59*a* resting on the light green fourteenth face 44*n* of the icosahedron 44. The orange second face 59*b* abuts against the right wall 103 and the yellow third face 59*c* faces the case door 106 of the tetrahedron case 101. The fourth small tetrahedron 52 is next placed in the case interior 105, with the blue first face 52*a* resting on the blue sixth face 44*f* of the icosahedron 44, the blue second face 52*b* resting on the blue fourth face 47*d* of the third icosa pyramid 47, the light green third face 52*c* abutting against the light green first face 59*a* of the fifth large tetrahedron 59 and the blue fourth face 52*d* facing the closed case door 106 of the tetrahedron case 101. The fifth small tetrahedron 53 is next placed in the case interior 105, with the blue first face 53*a* resting on the blue eleventh face 44*k* of the icosahedron 44 and the yellow second face 53*b* abutting against the yellow fourth face 57*d* of the third large tetrahedron 57. The light green third face 53*c* abuts against the left wall 102 of the tetrahedron case 101. The fourth icosa pyramid 48 is then placed in the case interior 105, with the orange first face 48*a* resting on the orange fifteenth face 44*o* of the icosahedron 44, the light green second face 48*b* abutting against the light green fourth face 59*d* of the fifth large tetrahedron 59 and the blue third face 48*c* abutting against the blue fourth face 53*d* of the fifth small tetrahedron 53. The sixth large tetrahedron 60 is next fitted in the case interior 105, with the light green first face 60*a* resting against the light green fourth face 46*d* of the second icosa pyramid 46 and the light green second face 60*b* resting against the light green ninth face 44*i* of the icosahedron 44. The blue third face 60*c* abuts against the left wall 102 and the yellow fourth face 60*d*, against the closed case door 106, of the tetrahedron case 101. To complete assembly of the icosa tetra 43, the sixth small tetrahedron 54 is fitted in the remaining space in the case interior 105, with the yellow first face 54*a* abutting against the yellow fourth face 48*d* of the fourth icosapyramid 48, the yellow second face 54*b* resting on the yellow eighth face 44*h* of the icosahedron 44, the light green third face 54*c* abutting against the light green second face 60*b* of the sixth large tetrahedron 60 and the blue fourth face 54*d* facing the case door 106 of the tetrahedron case 101. Finally, the case door 106 of the tetrahedron case 101 is closed.

As illustrated in FIGS. 1 and 2 of the drawings, when the polyhedron blocks are assembled into the icosa tetra 43 according to the foregoing description, each face of the icosa tetra 43 is bordered by the same color. For example, the front face 43*a*, corresponding to the case door 106 of the tetrahedron case 101, is bordered by the yellow third face 58*c* of the fourth large tetrahedron 58, the yellow third face 59*c* of the fifth large tetrahedron 59 and the yellow fourth face 60*d* of the sixth large tetrahedron 60. Likewise, the right face 43*b*, corresponding to the right wall 103 of the tetrahedron case 101, is bordered by the orange first face 56*a* of the second large tetrahedron 56, the orange third face 57*c* of the third large tetrahedron 57 and the orange second face 59*b* of the fifth large tetrahedron 59. Furthermore, the faces of all small tetrahedra on each face of the icosa tetra 43 have the same color. For example, on the front face 43*a* of the icosa tetra 43, the blue fourth face 51*d* of the third small tetrahedron 51, the blue fourth face 52*d* of the fourth small tetrahedron 52 and the blue fourth face 54*d* of the sixth small tetrahedron 54 appear. At an intermediate level of difficulty in assembling the icosa tetra 43, the polyhedron blocks are assembled in the tetrahedron case 101 to form the above-described color pattern on each face of the icosa tetra 43, but without regard to matching colors of abutting faces of adjacent polyhedron blocks. At an elementary level of difficulty of assembling the icosa tetra 43, the polyhedron blocks are placed in the tetrahedron case 101 in the same orientations as described above, except without regard to matching colors of abutting surfaces on adjacent polyhedron blocks or formation of the prescribed color pattern, as heretofore described with respect to assembly of the octahedron 3 and dual tetra 30, respectively. It is understood that each color on the respective faces of each polyhedron block can be substituted by a color other than those described above, with the same color on different faces substituted by the same color. Accordingly, matching colors of abutting faces on adjacent polyhedron blocks according to the advanced level of difficulty described above would provide the same degree of difficulty in assembling the icosa tetra 43, as well as the prescribed color pattern formation on each face of the icosa tetra 43.

Figure 6:
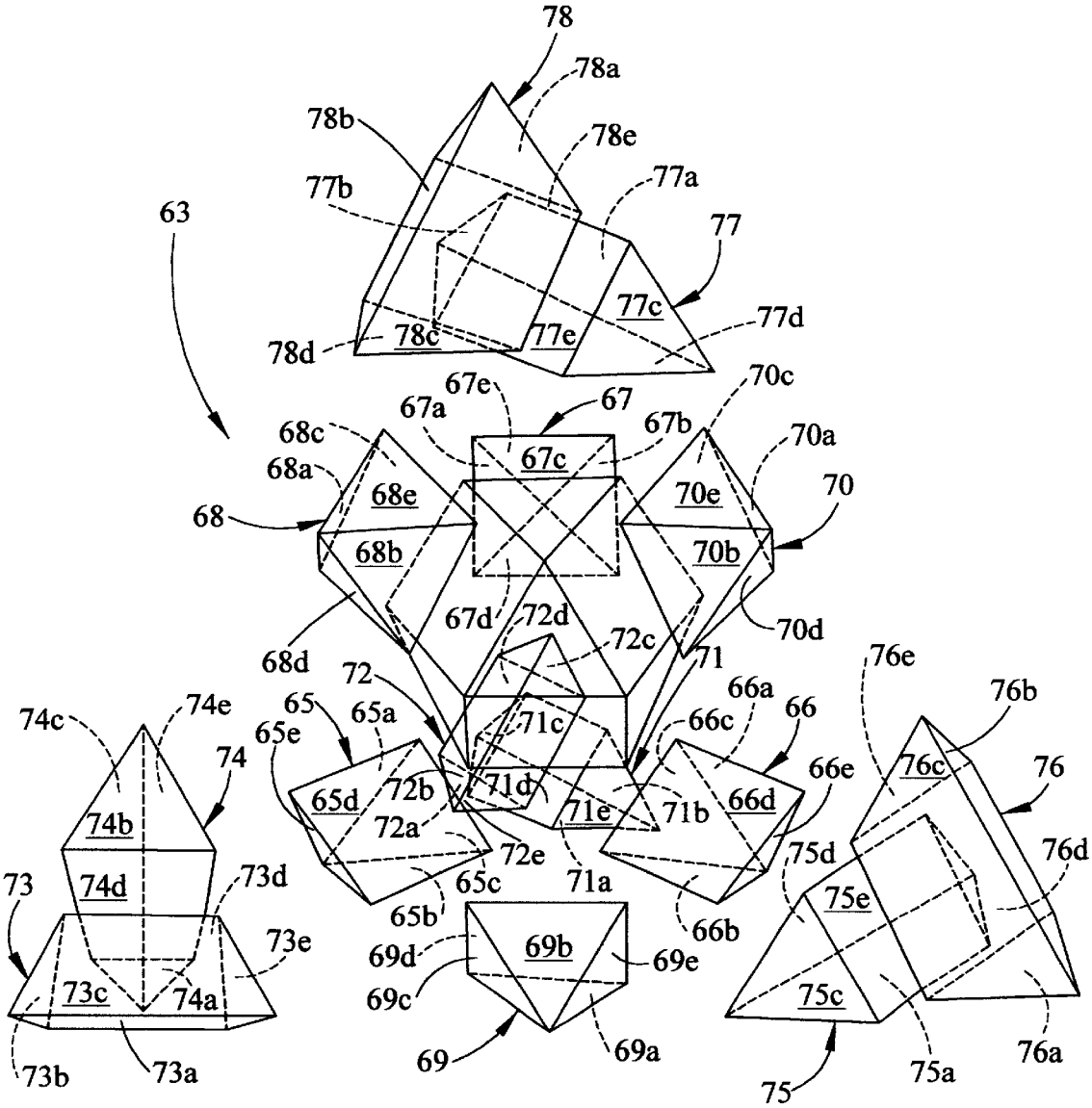
FIG. 6 is an exploded view of a cubocta tetrahedron component of the multipolyhedral puzzles.
Figure 6A:
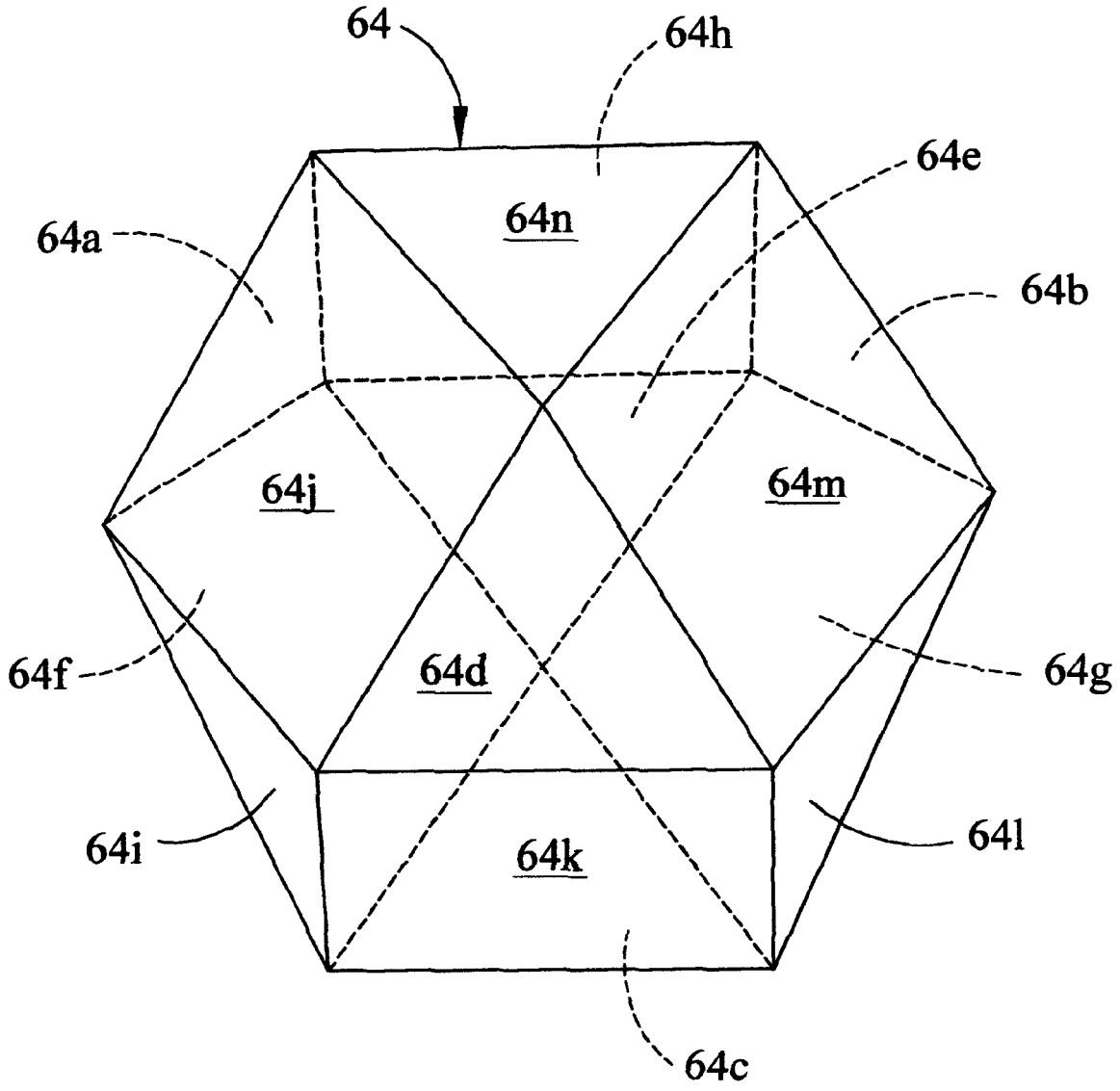
FIG. 6A is a perspective view of the central, cuboctahedral polyhedron block of the cubocta tetrahedron illustrated in FIG. 6.
Figure 6B:
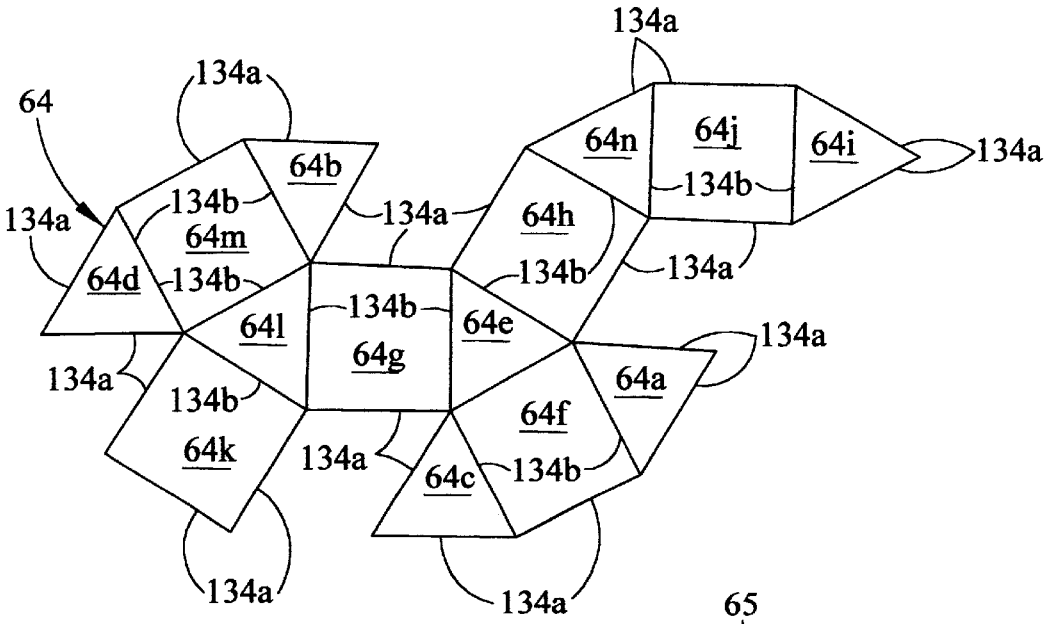
FIG. 6B is a bottom view of an unfolded, cuboctahedron polyhedron block of the cubocta tetra illustrated in FIG. 6.
Figure 6C:
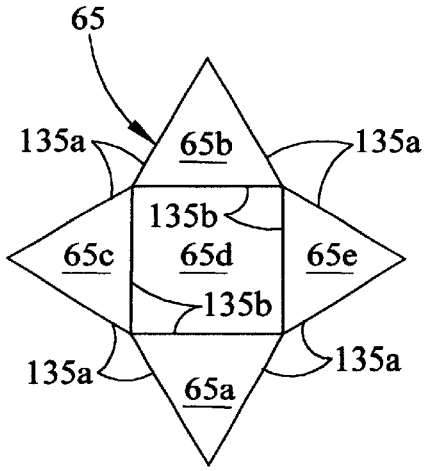
FIG. 6C is a bottom view of an unfolded, first square pyramid polyhdron block of the cubocta tetra.
Figure 6D:
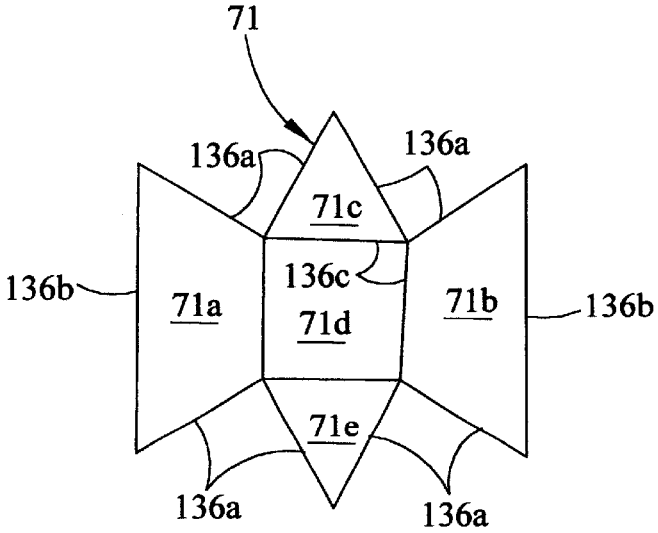
FIG. 6D is a bottom view of an unfolded, first pentahedron polyhedron block of the cubocta tetra.

Referring next to FIGS. 6–6D of the drawings, the cubocta tetra 63 is assembled from multiple polyhedron blocks in a second tetrahedron case 101 (FIG. 2) according to an advanced, intermediate or elementary level of difficulty, as hereinafter described. The cubocta tetra 63 includes a cuboctahedron 64, illustrated in unfolded configuration in FIG. 6B and including fourteen faces designated by reference numerals 64*a*–64*n*, respectively. The cuboctahedron 64 is constructed from the unfolded configuration by folding along the fold lines 134*b* and joining the face edges 134*a* of adjacent faces to form the cuboctahedron illustrated in FIG. 6A, according to the knowledge of those skilled in the art. The proportion of the length of each edge of the tetrahedron case 101 to the length of each of the face edges 134*a* and fold lines 134*b*, is 1:0.25.

The cubocta tetra 63 further includes a first square pyramid 65, illustrated in unfolded configuration in FIG. 6C and having a first face 65*a*, a second face 65*b*, a third face 65*c*, a fourth face 65*d* and a fifth face 65*e*. The first square pyramid 65 is constructed from the unfolded configuration by folding along the fold lines 135*b* and joining the face edges 135*a* of adjacent faces to form the first square pyramid 65 illustrated in FIG. 6. The proportion of the length of each edge of the tetrahedron case 101 to the length of each of the face edges 135*a* and fold lines 135*b*, is 1:0.25. The cubocta tetra 63 also includes a second square pyramid 66, a third square pyramid 67, a fourth square pyramid 68, a fifth square pyramid 69 and a sixth square pyramid 70, each of which has the same configuration and dimensions as the first square pyramid 65 described above with respect to FIG. 6C.

The cubocta tetra 63 still further includes a first pentahedron 71, illustrated in unfolded configuration in FIG. 6D and having a first face 71*a*, a second face 71*b*, a third face 71*c*, a fourth face 71*d* and a fifth face 71*e*. The first pentahedron 71 is constructed from the unfolded configuration by folding along the fold lines 136*c* and joining the long face edges 136*b* and short face edges 136*a* to form the first pentahedron 71 illustrated in FIG. 6. The proportion of the length of each face of the tetrahedron case 101 to the length of each of the short face edges 136*a*, the long face edges 136*b* and the fold lines 136*c*, is 1:0.25, 1:0.50, and 1:0.25, respectively. The cubocta tetra 63 also includes a second pentahedron 72, a third pentahedron 73, a fourth pentahedron 74, a fifth pentahedron 75, a sixth pentahedron 76, a seventh pentahedron 77 and an eighth pentahedron 78, each of which has the same configuration and dimensions as the first pentahedron 71 described above with respect to FIG. 6D.

Referring again to FIGS. 1–3 and particularly to FIGS. 6 and 6*a* of the drawings, at an advanced level of difficulty in assembling the cubocta tetra 63 inside a third transparent tetrahedron case 101 according to one of several possible methods, the first pentahedron 71 is initially fitted in the case interior 105 at a vertex 101*a* of the open tetrahedron case 101. The purple first face 71*a* rests on the bottom wall 104, the green second face 71*b* abuts against the right wall 103 and the blue third face 71*c* against the left wall 102 of the tetrahedron case 101. The second pentahedron 72 is next fitted in the case interior 105, with the purple first face 72*a* resting on the bottom wall 104 and the blue second face 72*b* abutting against the left wall 102 and the green third face 72*c* against the right wall 103 of the tetrahedron case 101. The light green fourth face 72*d* rests against the light green fourth face 71*d* of the first pentahedron 71. The first square pyramid 65 is then placed in the case interior 105, with the green first face 65*a* abutting against the left wall 102 and the green second face 65*b* resting on the bottom wall 104 of the tetrahedron case 101. The light green third face 65*c* abuts against the light green fifth face 72*e* of the second pentahedron 72. The second square pyramid 66 is then placed in the case interior 105, with the blue first face 66*a* abutting against the right wall 103 and the blue second face 66*b* resting on the bottom wall 104 of the tetrahedron case 101. The light green third face 66*c* abuts against the light green fifth face 71*e* of the first pentahedron 71. The cuboctahedron 64 (FIG. 6A) is next placed in the case interior 105, with the light green first face 64*a* abutting against the left wall 102, the light green second face 64*b*, against the right wall 103, the light green third face 64*c* resting on the bottom wall 104 and the light green fourth face 64*d* facing the case door 106 of the tetrahedron case 101. The light green fifth face 64*e* of the cuboctahedron 64 rests against the light green fifth face 72*e* of the second pentahedron 72, the blue sixth face 64*f* against the blue fourth face 65*d* of the first square pyramid 65 and the purple seventh face 64*g* against the purple fourth face 66*d* of the second square pyramid 66. The third square pyramid 67 is next placed in the case interior 105, with the purple first face 67*a* abutting against the left wall 102 and the purple second face 67*b* against the right wall 103 of the tetrahedron case 101. The green third face 67*c* rests against the green eighth face 64*h* of the cuboctahedron 64 and the light green fourth face 67*d* rests on the light green fifth face 72*e* of the second pentahedron 72. The third pentahedron 73 is next placed in the case interior 105 at another vertex 101*a* thereof with the blue first face 73*a* resting on the bottom wall 104, the purple second face 73*b* abutting against the left wall 102 and the third green face 73*c* facing the case door 106 of the tetrahedron case 101. The fourth pentahedron 74 is next placed in the case interior 105, with the blue first face 74*a* resting on the bottom wall 104, the green second face 74*b* facing the case door 106 and the purple third face 74*c* abutting against the left wall 102 of the tetrahedron case 101. The blue fourth face 74*d* rests on the blue fourth face 73*d* of the third pentahedron 73 and the light green fifth face 74*e* against the light green ninth face 64*i* of the cuboctahedron 64 and the light green fifth face 65*e* of the first square pyramid 65. The fourth square pyramid 68 is then placed in the case interior 105, with the blue first face 68*a* abutting against the left wall 102 and the blue second face 68*b*, facing the case door 106 of the tetrahedron case 101. The purple third face 68*c* rests against the purple tenth face 64*j* of the cuboctahedron 64 and the light green fourth face 68*d* rests on the light green fifth face 74*e* of the fourth pentahedron 74. The fifth square pyramid 69 is then placed between the fourth pentahedron 74 and the cuboctahedron 64, with the purple first face 69*a* resting on the bottom wall 104 and the purple second face 69*b* facing the case door 106 of the tetrahedron case 101. The light green third face 69*c* rests against the light green fifth face 73*e* of the third pentahedron 73 and the green fourth face 69*d* abuts against the green eleventh face 64*k* of the cuboctahedron 64. The fifth pentahedron 75 is next placed in the case interior 105 at another vertex 101*a* thereof with the green first face 75*a* resting on the bottom wall 104, the purple second face 75*b* abutting against the right wall 103 and the blue third face 75*c* facing the case door 106 of the tetrahedron case 101. The light green fourth face 75*d* abuts against the light green fifth face 69*e* of the fifth square pyramid 69, the light green twelfth face 641 of the cuboctahedron 64 and the light green fifth face 66*e* of the second square pyramid 66. The sixth pentahedron 76 is then placed in the case interior 105, with the green first face 76*a* resting on the bottom wall 104, the purple second face 76*b* abutting against the right wall 103 and the blue third face 76*c* facing the case door 106 of the tetrahedron case 101. The purple fourth face 76*d* rests against the purple fifth face 75*e* of the fifth pentahedron 75. The sixth square pyramid 70 is next fitted in the case interior 105, with the green first face 70*a* abutting against the right wall 103 and the green second face 70*b* facing the case door 106 of the tetrahedron case 101. The blue third face 70*c* rests against the blue thirteenth face 64*m* of the cuboctahedron 64 and the light green fourth face 70*d*, against the light green fifth face 76*e* of the sixth pentahedron 76. The seventh pentahedron 77 is next placed in the case interior 105, with the blue first face 77*a* abutting against the right wall 103, the green second face 77*b*, against the left wall 102 and the purple third face 77*c* facing the case door 106 of the tetrahedron case 101. The light green fourth face 77*d* rests on the light green fifth face 70*e* of the sixth square pyramid 70, the light green fourteenth face 64*n* of the cuboctahedron 64 and the light green fifth face 67*e* of the third square pyramid 67. To complete assembly of the cubocta small tetrahedron 63 in the tetrahedron case 101, the eighth pentahedron 78 is placed in the remaining space in the case interior 105 at the remaining vertex 101*a* thereof with the blue first face 78*a* abutting against the right wall 103 and the green second face 78*b* abutting against the left wall 102 and the purple third face 78*c* facing the case door 106 of the tetrahedron case 101. The light green fourth face 78*d* rests on the light green fifth face 68*e* of the fourth square pyramid 68 and the green fifth face 78*e* rests against the green fifth face 77*e* of the seventh pentahedron 77. Finally, the case door 106 of the tetrahedron case 101 is closed.

As illustrated in FIGS. 1 and 2 of the drawings, when the polyhedron blocks are assembled into the cubocta tetra 63 according to the foregoing description, each of the three vertices on each face of the cubocta tetra 30 is one of three colors. For example, on the front face 63*a* of the cubocta tetra 63, corresponding to the case door 106 of the tetrahedron case 101, the vertex formed by the third face 73*c* of the third pentahedron 73 and second face 74*b* of the fourth pentahedron 74, is green; the vertex formed by the third face 75*c* of the fifth pentahedron 75 and third face 76*c* of the sixth pentahedron 76, is blue; and the vertex formed by the third face 77*c* of the seventh pentahedron 77 and third face 78*c* of the eighth pentehedron 78, is purple. Furthermore, the three faces of the respective square pyramids on each face of the cubocta tetra 63 are three different colors. On the front face 63*a* of the cubocta tetra 63, for example, the second face 68*b* of the fourth square pyramid 68 is blue, the second face 69*b* of the fifth square pyramid 69 is purple and the second face 70*b* of the sixth square pyramid 70 is green. As in the cases with respect to the octahedron 3, dual tetra 30 and icosa tetra 43, respectively, described above, at an intermediate level of difficulty in assembling the cubocta tetra 63, the polyhedron blocks are assembled in the tetrahedron case 101 to form the color pattern described above on each face of the cubocta tetra 63, but without regard to matching colors of abutting faces of adjacent polyhedron blocks. At an elementary level of difficulty in assembling the cubocta tetra 63 from the constituent polyhedron blocks, the cubocta tetra 63 is assembled in the tetrahedron case 101 without regard to matching colors of abutting faces on adjacent polyhedron blocks or color pattern formation on the respective faces of the cubocta tetra 63. It is understood that each color on the respective faces of each polyhedron block can be substituted by a color other than those described above, with the same color on different faces substituted by the same color. Such color substitution would provide the same degree of difficulty in assembling the cubocta tetra 63, as well as the prescribed color pattern formation on each face of the cubocta tetra 63, when the cubocta tetra 63 is assembled according to the advanced level of difficulty described above.

Figure 7:
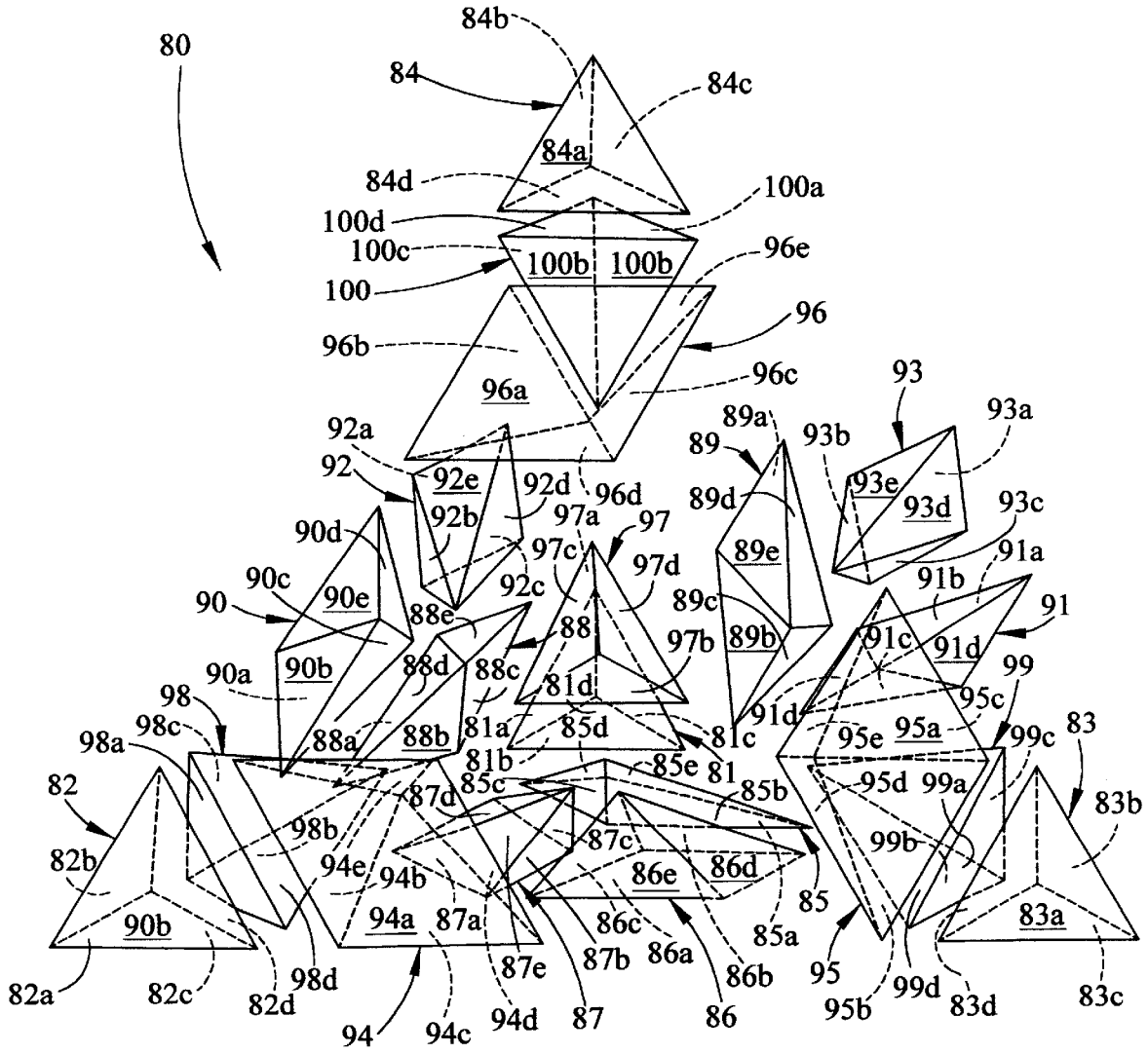
FIG. 7 is an exploded view of a truncated tetrahedron component of the multi-polyhedral puzzles.
Figure 7A:
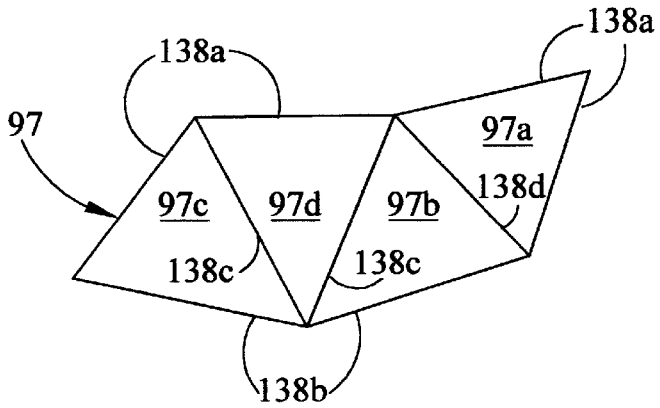
FIG. 7A is a bottom view of an unfolded, first T-tetrahedron polyhedron block of the T-tetra illustrated in FIG. 7.
Figure 7B:
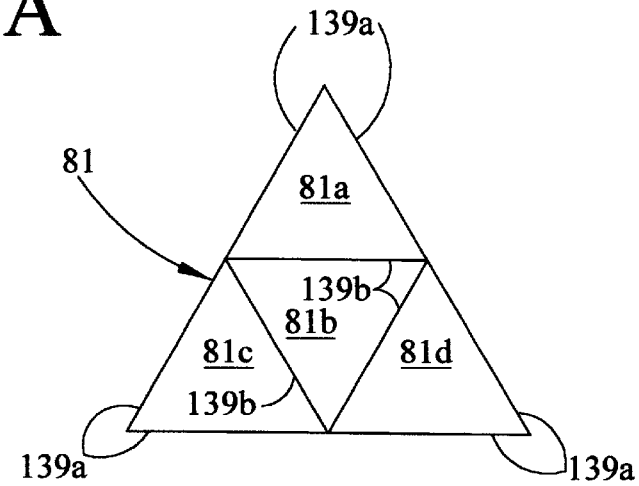
FIG. 7B is a bottom view of an unfolded, first T-tripyramid polyhedron block of the T-tetra.
Figure 7C:
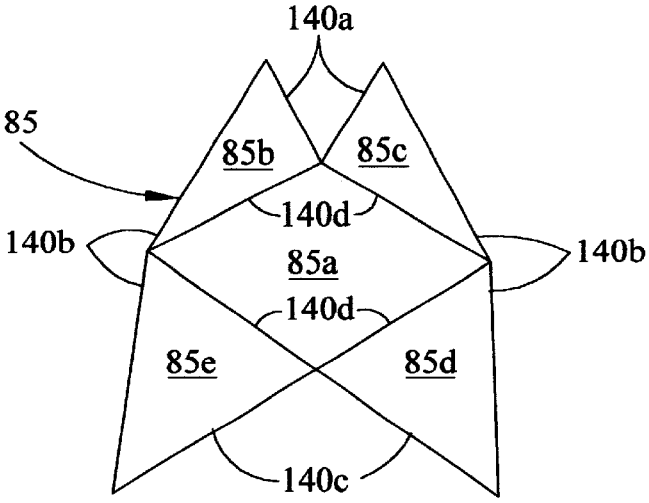
FIG. 7C is a bottom view of an unfolded, first T-pentahedron polyhedron blocks of the T-tetra.

Referring now to FIGS. 7–7C of the drawings, the T-tetra 80 is assembled from multiple polyhedron blocks in a fourth tetrahedron case 101 (FIG. 2) according to an advanced, intermediate or elementary level of difficulty, as hereinafter described. The T-tetra 80 includes a first T-tetrahedron 97, illustrated in unfolded configuration in FIG. 7A and including a base or first face 97*a*, a second face 97*b*, a third face 97*c* and a fourth face 97*d*. The first T-tetrahedron 97 is constructed from the unfolded configuration by folding along the fold lines 138*c* and base fold line 138*d* and joining the base edges 138*a* and face edges 138*b* to form the first T-tetrahedron 97 illustrated in FIG. 7. The proportion of the length of each edge of the tetrahedron case 101 to the length of each of the base edges 138*a*, face edges 138*b*, fold lines 138*c* and base fold line 138*d*, is 1:0.3333, 1:0.3908, 1:0.3908, and 1:0.3333, respectively. The T-tetra 80 includes a second T-tetrahedron 98, a third T-tetrahedron 99, and a fourth T-tetrahedron 100, each of which has the same configuration and dimensions as the first T-tetrahedron 97 described above with respect to FIG. 7A.

The T-tetra 80 further includes a first T-tripyramid 81, illustrated in the unfolded configuration in FIG. 7B and including a first face 81*a*, a second face 81*b*, a third face 81*c* and a fourth face 81*d*. The first T-tripyramid 81 is constructed from the unfolded configuration by folding along the fold lines 139*b* and joining the face edges 139*a* of adjacent faces to form the first T-tripyramid 81 illustrated in FIG. 7. The proportion of the length of each edge of the tetrahedron case 101 to the length of each of the face edges 139*a* and fold lines 139*b*, is 1:0.3333. The T-tetra 80 includes a second T-tripyramid 82, a third T-tripyramid 83 and a fourth T-tripyramid 84, each of which has the same configuration and dimensions as the first T-tripyramid 81 described above with respect to FIG. 7B. The T-tetra 80 still further includes a first T-pentahedron 85, illustrated in unfolded configuration in FIG. 7*c* and including a first face 85*a*, a second face 85*b*, a third face 85*c*, a fourth face 85*d* and a fifth face 85*e*. The first Tpentahedron 85 is constructed from the unfolded configuration by folding along the fold lines 140*d* and joining the respective side edges 140*b*, the front edges 140*a* and the rear edges 140*c*, to form the first T-pentahedron 85 illustrated in FIG. 7. The proportion of the length of each edge of the tetrahedron case 101 to the length of each of the front edges 140*a*, the side edges 104*b* the rear edges 140*c* and the fold lines 140*d* is 1:0.2154, 1:0.3908, 1:0.3908 and 1:0.3333, respectively. The T-tetra 80 also includes a second T-pentahedron 86, a third T-pentahedron 87, a fourth T-pentahedron 88, a fifth T-pentahedron 89, a sixth T-pentahedron 90, a seventh T-pentahedron 91, an eighth T-pentahedron 92, a ninth T-pentahedron 93, a tenth T-pentahedron 94, an eleventh T-pentahedron 95 and a twelfth T-pentahedron 96, each of which has the same configuration and dimensions as the first T-pentahedron 85 described above with respect to FIG. 7*c*.

Referring again to FIGS. 1–3 and particularly to FIG. 7 of the drawings, at an advanced level of difficulty in assembling the truncated tetra 80 in a fourth tetrahedron case 101 and according to one of several possible methods, the first T-tripyramid 81 is initially placed in the case interior 105 at a vertex 101*a* thereof with the green first face 81*a* abutting against the left wall 102, the green bottom or second face 81*b* resting on the bottom wall 104 and the green third face 81*c* abutting against the right wall 103 of the tetrahedron case 101. The first T-pentahedron 85 is next fitted in the case interior 105, in bordering relationship to the first T-pyramid 81, with the red bottom or first face 85*a* resting on the bottom wall 104 of the tetrahedron case 101. The second T-pentahedron 86 is then placed in the case interior 105, with the blue first face 86*a* resting on the bottom wall 104 of the tetrahedron case 101 and the green second face 86*b* abutting against the green second face 85*b* of the first T-pentahedron 85. The third T-pentahedron 87 is then placed in the case interior 105, with the yellow bottom or first face 87*a* resting on the bottom wall 104 of the tetrahedron case 101, the green second face 87*b* abutting against the green third face 86*c* of the second T-pentahedron 86 and the green third face 87*c* abutting against the green third face 85*c* of the first T-pentahedron 85. The first T-tetrahedron 97 is next placed in the case interior 105, with the green first face 97*a* abutting against the green fourth face 81*d* of the first T-tripyramid 81 and the yellow second face 97*b* resting on the yellow fourth face 85*d* of the first T-pentahedron 85. The fourth T-pentahedron 88 is next placed in the case interior 105, with the yellow first face 88*a* abutting against the left wall 102 of the tetrahedron case 101. The red second face 88*b* abuts against the red fourth face 87*d* of the third T-pentahedron 87 and the blue third face 88*c* rests against the blue third face 97*c* of the first T-tetrahedron 97. The fifth T-pentahedron 89 is then placed in the case interior 105, with the blue first face 89*a* resting against the right wall 103 of the tetrahedron case 101 and the red second face 89*b* resting against the red fourth face 97*d* of the first T-tetrahedron 97. The second T-tripyramid 82 is fitted in the case interior 105 at another vertex 101*a* thereof, with the green first face 82*a* facing the case door 106, the green second face 82*b* abutting against the left wall 102 and the green bottom or third face 82*c* resting on the bottom wall 104 of the tetrahedron case 101. The second T-tetrahedron 98 is next placed in the case interior 105, with the green first face 98*a* abutting against the green fourth face 82*d* of the second T-tripyramid 82 and the blue second face 98*b* resting on the blue fifth face 87*e* of the third T-pentahedron 87. The sixth T-pentahedron 90 is then placed in the case interior 105, with the red first face 90*a* abutting against the left wall 102 of the tetrahedron case 101. The yellow second face 90*b* rests against the yellow third face 98*c* of the second T-tetrahedron 98 and the green third face 90*c* abuts against the green fourth face 88*d* of the fourth T-pentahedron 88. The third T-tripyrarnid 83 is then placed in the case interior 105 at another vertex 101*a* thereof with the green first face 83*a* facing the case door 106, the green second face 83*b* abutting against the right wall 103 and the green bottom or third face 83*c* resting on the bottom wall 104 of the tetrahedron case 101. The third T-tetrahedron 99 is next placed in the case interior 105, with the green first face 99*a* resting against the green fourth face 83*d* of the third T-tripyramid 83 and the red second face 99*b* resting on the red fourth face 86*d* of the second pentahedron 86. The seventh T-pentahedron 91 is next placed inside the case interior 105, with the red first face 91*a* resting abutting against the right wall 103 of the tetrahedron case 101. The yellow second face 91*b* rests against the yellow third face 99*b* of the third T-tetrahedron 99, the blue third face 91*e*, against the blue fifth face 85*e* of the first T-pentahedron 85 and the green fourth face 91*c*, against the green third face 89*b* of the fifth T-pentahedron 89. The eighth T-pentahedron 92 is next placed in the case interior 105, with the blue first face 92*a* abutting against the left wall 102 of the tetrahedron case 101. The green second face 92*b* rests against the green fourth face 90*c* of the sixth T-pentahedron 90, the green third face 92*c* rests on the green fifth face 88*b* of the fourth T-pentahedron 88 and the yellow fourth face 92*e* abuts against the yellow fifth face 89*e* of the fifth T-pentahedron 89. The ninth T-pentahedron 93 is then placed in the case interior 105, with the yellow first face 93*a* abutting against the right wall 103 of the tetrahedron case 101. The green second face 93*b* rests on the green fourth face 89*c* of the fifth T-pentahedron 89 and the green third face 93*c* rests on the green fifth face 91*b* of the seventh T-pentahedron 91. The tenth T-pentahedron 94 is next placed in the case interior 105, with the blue first face 94*a* facing the case door 106 of the tetrahedron case 101. The red second face 94*d* abuts against the red fourth face 98*d* of the second T-tetrahedron 98 and the yellow third face 94*e*, against the yellow fifth face 86*e* of the second T-pentahedron 86. The eleventh T-pentahedron 95 is next placed in the case interior 105, with the yellow first face 95*a* facing the case door 106 of the tetrahedron case 101. The blue second face 95*d* abuts against the blue fourth face 99*c* of the third T-tetrahedron 99, the red third face 95*e* against the red fourth face 93*e* of the seventh T-pentahedron 93 and the green fourth face 95*b* against the green fourth face 94*c* of the tenth T-pentahedron 94. The twelfth pentahedron 96 is next placed in the case interior 105, with the red first face 96*a* facing the case door 106 of the tetrahedron case 101. The blue second face 96*e* abuts against the blue fifth face 90*e* of the sixth T-pentahedron 90, the green third face 96*b* against the green fifth face 95*c* of the eleventh T-pentahedron 95 and the green fourth face 96*c* against the green fifth face 94*b* of the tenth T-pentahedron 94. The inverted, fourth T-tetrahedron 100 is next placed in the case interior 105, with the blue first face 100*c* resting against the blue fifth face 93*d* of the ninth T-pentahedron 93, the yellow second face 100*b*, against the yellow fifth face 96*d* of the twelfth T-pentahedron 96 and the red third face 100*d* against the red fifth face 92*d* of the eighth T-pentahedron 92. Finally, to complete assembly of the truncated tetra 80 in the tetrahedron case 101, the fourth T-tripyramid 84 is fitted in the remaining space in the case interior 105 at the remaining vertex 101*a* thereof with the green first face 84*a* facing the case door 106, the green second face 84*b* abutting against the left wall 102 and the green third face 84*c* against the right wall 103 of the tetrahedron case 101. The green bottom or fourth face 84*d* rests on the green top or fourth face 100*a* of the fourth T-tetrahedron 100.

As illustrated in FIGS. 1 and 2 of the drawings, when the polyhedron blocks are assembled in the truncated tetra 80 according to the foregoing description, each vertex of the truncated tetra 80 formed by the first, second, third and fourth T-tripyramids, respectively, is green in color. Furthermore, the faces of the three T-pentahedra on each face of the truncated small tetrahedron are red, yellow and blue, respectively. For example, on the front face 80*a* of the truncated tetra 80 corresponding to the case door 106 of the tetrahedron case 101, the first face 94*a* of the tenth T-pentahedron 94*a* is blue, the first face 95*a*; of the eleventh T-pentahedron 95 is yellow and the first face 96*a* of the twelfth pentahedron 96 is red. As described above with respect to the octahedron 3, the dual tetra 30, the icosa tetra 43 and the cubocta tetra 63, at an intermediate level of difficulty in assembling the truncated tetra 80, the polyhedron blocks are assembled in the tetrahedron case 101 to form the above-described, four-color pattern on each face of the truncated tetra 80, but without regard to matching colors of abutting faces of adjacent polyhedron blocks. At an elementary level of difficulty in assembling the truncated tetra 80, the polyhedron blocks are assembled in the tetrahedron case 101 without regard to matching colors of abutting surfaces on adjacent polyhedron blocks or formation of the above-described color pattern formation on each face of the truncated tetra 80. It is understood that each color on the respective faces of each polyhedron blocks can be substituted by a color other than those described above, with the same color on different faces substituted by the same color. As described above with respect to the octahedron 3, the dual tetra 30, the icosa tetra 43 and the cubocta tetra 63, such color substitution would provide the same degree of difficulty in assembling the truncated tetra 80, as well as the prescribed color pattern formation on each face of the truncated tetra 80, when the truncated tetra 80 is assembled according to the advanced level of difficulty described above.

It will be appreciated by those skilled in the art that the above descriptions of assembling the octahedron 3, dual tetra 30, icosa tetra 43, cubocta tetra 63 and truncated tetra 80, respectively, according to the advanced level of difficulty, represents only one of several possible solutions to solving the puzzles 1. Assembly of each of the octohedron 3 or tetrahedra according to the advanced level of difficulty and formation of the prescribed color pattern on the respective faces of the octahedron 3 or tetrahedron, can be accomplished by any method of placing the constituent polyhedron blocks in the respective octahedron case 108 or tetrahedron case 101, in the same orientations described above, and in which abutting faces of adjacent polyhedron blocks match in color. It will be further appreciated by those skilled in the art that the polyhedron blocks of the octahedron 3 or each of the tetrahedra can be constructed from wood, molded plastic or any other lightweight, durable material, according to the knowledge of those skilled in the art.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A multi-polyhedral puzzle conprising an octahedron having eight octahedron faces, said octahedron comprising an octahedron set of polyhedron blocks including a central cube inscribed in said octahedron, said central cube having eight block corners, whereby said block corners of said central cube meet said eight octahedron faces, respectively; and each of said octahedron set of polyhedron blocks having a plurality of block faces each having one of a purality of colors, wherein block faces of each of said polyhedron blocks are disposed in flcing relationship to block faces of adjacent ones of said polyhedron blocks to define said octahedron and said block faces disposed in facing relationship define a pair of block faces on respective adjacent ones of said polyhedron blocks, and said pair of block faces can selectively be matched in color to define a prescribed color pattern on each of said eight octahedron faces of said octahedron.

2. The multi-polyhedral puzzle of claim 1 wherein said octahedron set of polyhedron blocks further comprises:

(a). a first irregular tetrahedron;

(b). a second irregular tetrahedron provided in bordering relationship to said first irregular tetrahedron;

(c). a third irregular tetrahedron provided in bordering relationship to said second irregular tetrahedron;

(d). a fourth irregular tetrahedron provided in bordering relationship to said first irregular tetrahedron and said third irregular tetrahedron;

(e). a bottom tetrapyramid cradled in inverted position between said first irregular tetrahedron, said second irregular tetrahedron, said third irregular tetrahedron and said fourth irregulr tetrahedron, with block faces of said bottom tetrapyramid disposed in facing relationship to block ices of said first, second, third and fourth irregular tetrahedra, respectively;

(f). a fifth irregular tetrahedron provided in bordering relationship with said third irregular tetrahedron and said fourth irregular tetrahedron;

(g). a left rear tetrapyramid provided above said fourth irregular tetrahedron and adjacent to said fifth irregular tetrahedron, with block faces of said left rear tetrapyramid disposed in facing relationship to block faces of said fourth irregular tetrahedron and said fifth irregular tetrahedron, respectively;

(h). a right rear tetrapyramid provided above said third irregular tetrahedron and adjacent to said fifth irregular tetrahedron, opposite said left rear tetrapyramid, with block faces of said right rear tetrapyramid disposed in facing relationship to block faces of said third irregular tetrahedron and said fifth irregular tetrahedron, respectively, and with block faces of said central cube disposed in facing relationship to block faces of said left rear tetrapyramid and said right rear tetrapymid, respectively;

(i). a sixth irregular tetrahedron provided in bordering relationship to said first irregular tetrahedron and said fourth irregular tetrahedron, with a block face of said sixth irregular tetrahedron disposed in facing relationship to a block face of said left rear tetrapyramid;

(j). a seventh irregular tetrahedron provided in bordering relationship to said second irregular tetrahedron and said third irregular tetrahedron, with a block face of said seventh irregular tetrahedron disposed in facing relationship to a block face of said right rear tetrapyramid;

(k). a left front tetrapyramid provided above said first irregular tetrahedron, with block faces of said left front tetrapyramid disposed in facing relationship to block faces of said first irregular tetrahedron, said sixth irregular tetrahedron and said octahedron cube;

(l). a right front tetrapyramid provided above said second irregular tetrahedron, with block faces of said right front tetrapyramid disposed in facing relationship to block faces of said second irregular tetrahedron, said seventh irregular tetrahedron and said octahedron cube;

(m). an eighth irregular tetrahedron provided in bordering relationship to said first irregular tetrahedron and said second irregular tetrahedron, with block faces of said eighth irregular tetrahedron disposed in facing relationship to block faces of said left front tetrapyramid and said right front tetrapyramid, respectively;

(n). a ninth irregular tetrahedron provided above said left rear tetrapyramid and in bordering relationship to said fifth irregular tetrahedron and said sixth irregular tetrahedron, with a block face of said ninth irregular tetrahedron disposed in facing relationship to a block face of said left rear tetrapyramid;

(o). a tenth irregular tetrahedron provided above said right rear tetrapyramid and in bordering relationship to said fifth irregular tetrahedron, said seventh irregular tetrahedron and said ninth irregular tetrahedron, with a block face of said tenth irregular tetrahedron disposed in facing relationship to a block face of said right rear tetrapyramid;

(p). a top tetrapyramid provided above said central octahedron cube, with block faces of said top tetrapyramid disposed in facing relationship to block faces of said octahedron cube, said ninth irregular tetrahedron and said tenth irregular tetrahedron, respectively;

(q). an eleventh irregular tetrahedron provided in bordering relationship to said seventh irregular tetrahedron, said eighth irregular tetrahedron and said tenth irregular tetrahedron, with block faces of said eleventh irregular tetrahedron disposed in facing relationship to block faces of said top tetrapyramid and said right front tetrapyramid, respectively; and (r). a twelfth irregular tetrahedron provided in bordering relationship to said sixth irregular tetrahedron, said eighth irregular tetrahedron, said ninth irregular tetrahedron and said eleventh irregular tetrahedron, with block faces of said twelfth irregular tetrahedron disposed in facing relationship to block faces of said top tetrapyramid and said left front tetrapyramid, respectively.

3. A multi-polyhedral puzzle comprising a tetrahedron having four tetrahedron faces and four vertices, said tetrahedron comprising a tetrahedron set of polyhedron blocks including a regular tetrahedron inscribed in said tetrahedron, said regular tetrahedron having four regular tetrahedron vertices, whereby said regular tetrahedron vertices meet said four tetrahedron faces, respectively, of said tetrahedron; and each of said tetrahedron set of polyhedron blocks having a plurality of block faces each having one of a plurality of colors, wherein block faces of each of said polyhedron blocks are disposed in facing relationship to block faces of adjacent ones of said polyhedron blocks to define said tetrahedron and said block faces disposed in facing relationship define a pair of block faces on respective adjacent ones of said polyhedron blocks, and said pair of block faces can selectively be matched in color to define a prescribed color pattern on each of said four tetrahedron faces of said tetrahedron.

4. The multi-polyhedral puzzle of claim 3 wherein said tetrahedron set of polyhedron blocks comprises:

(a). a first irregular, large tetrahedron;

(b). a second irregular, large tetrahedron provided in contiguous relationship to said first irregular, large tetrahedron;

(c). a rear tripyramid fitted between said first irregular, large tetrahedron and said second irregular, large tetrahedron, with block faces of said rear tripyramid disposed in facing relationship to block faces of said first irregular, large tetrahedron and said second irregular, large tetrahedron, respectively;

(d). a third irregular, large tetrahedron provided above said rear tripyramid, with a block face of said third irregular, large tetrahedron disposed in ficing relationship to a block face of said rear tripyramid;

(e). a fourth irregular, large tetrahedron provided between said first irregular, large tetrahedron and said second irregular, large tetrahedron;

(f). a left tripyramid provided between said first irregular, large tetrahedron and said fourth irregular, large tetrahedron, with block faces of said left tripyramid disposed in facing relationship to block faces of said first irregular, large tetrahedron and said fourth irregular, large tetrahedron, respectively;

(g). a right tripyramid provided between said second irregular, large tetrahedron and said fourth irregular, large tetrahedron, with block faces of said right tripyramid disposed in facing relationship to block faces of said second irregular, large tetrahedron and said fourth irregular, large tetrahedron, respectively, and with said regular tetrahedron fitted between said left tripyramid and said right tripyramid and block faces of said regular tetrahedron disposed in facing relationship to block faces of said rear tripyramid, said left tripyramid and said right tripyramid, respectively;

(h). a top tripyramid provided above said regular tetrahedron, with block ices of said top tripyramid disposed in facing relationship to block faces of said regular tetrahedron and said third irregular, large tetrahedron, respectively;

(i). a fifth irregular, large tetradron fitted adjacent to said fourth irregular, large tetrahedron, with block faces of said fifth irregular, large tetrahedron disposed in facing relationship to block faces of said top tripyramid and said left tripyramid, respectively; and (j). a sixth irregular, large tetrahedron fitted adjacent to said fifth irregular, large tetrahedron, with block faces of said sixth irregular, large tetrahedron disposed in facing relationship to block faces of said top tripyramid and said right tripyramid, respectively.

5. A multi-polyhedral puzzle comprising a tetrahedron having four tetrahedron faces and four vertices, said tetrahedron comprising a tetrahedron set of polyhedron blocks, each of said tetrahron set of polyhedron blocks having a plurality of block faces each having one of a plurality of colors, wherein block faces of each of said polyhedron blocks are disposed in facing relationship to block faces of adjacent ones of said polyhedron blocks to define said tetrahedron and said block faces disposed in facing relationship define a pair of block faces on respective adjacent ones of said polyhedron blocks, and said pair of block faces can selectively be matched in color to define a prescribed color pattern on each of said four tetrahedron faces of said tetrahedron; and wherein said tetrahedron set of polyhedron blocks includes an icosahedron inscribed in said tetrahedron, whereby four block faces of said icosahedron appear on said four tetrahedron faces, respectively, of said tetrahedron.

6. The multi-polyhedral puzzle of claim 5 wherein said tetrahedron set of polyhedron blocks comprises:

(a). a first large tetrahedron;

(b). a second large tetrahedron provided in said tetrahedron in spaced relationship to said first large tetrahedron;

(c). a first icosa pyramid fitted in said tetrahedron, with a block face of said first icosa pyramid disposed in facing relationship to a block face of said second large tetrahedron;

(d). a first small tetrahedron provided adjacent to said first icosa pyramid, with block faces of said first small tetrahedron disposed in facing relationship to block faces of said first icosa pyramid and said first large tetrahedron, respectively;

(e). a third large tetrahedron provided above said first icosa pyramid, with a block face of said third large tetrahedron disposed in facing relationship to a block face of said first icosa pyramid;

(f). a second small tetrahedron provided adjacent to said second large tetrahedron, with a block face of said second small tetrahedron disposed in facing relationship to a block face of said second large tetrahedron and block faces of said icosahedron disposed in facing relationship to block faces of said first small tetrahedron, said icosa pyramid, said second large tetrahedron, said second small tetrahedron and said first large tetrahedron, respectively;

(g). a second icosa pyramid fitted between said first large tetrahedron and said icosahedron, with block faces of said second icosa pyramid disposed in facing relationship to block faces of said icosahedron and said first large tetrahedron, respectively, (h). a fourth large tetrahedron fitted in said tetrahedron, with a block face of said fourth large tetrahedron disposed in facing relationship to a block face of said icosahedron;

(i). a third icosa pyramid provided between said second small tetrahedron and said icosahedron, with block faces of said third icosa pyramid disposed in facing relationship to said block faces of said icosahedron, said second small tetrahedron and said fourth large tetrahedron, respectively;

(j). a third small tetrahedron fitted between said second icosa pyramid and said fourth large tetrahedron, with said block faces of said third small tetrahedron disposed in facing relationship to block faces of said second icosa pyramid, said icosahedron and said fourth large tetrahedron, respectively;

(k). a fifth large tetrahedron fitted in said tetrahedron, with a block face of said fifth large tetrahedron disposed in facing relationship to a block face of said icosahedron;

(l). a fourth small tetrahedron provided between said icosahedron and said third icosa pyramid, with block faces of said fourth small tetrahedron disposed in facing relationship to block faces of said icosahedron, said third icosa pyramid and said fifth large tetrahedron, respectively;

(m). a fifth small tetrahedron fitted between said third large tetrahedron and said icosahedron, with block faces of said fifth small tetrahedron disposed in facing relationship to block faces of said icosahedron and said third large tetrahedron, respectively;

(n). a fourth icosa pyramid provided between said fifth large tetrahedron and said icosahedron, with block faces of said fourth icosa pyramid disposed in facing relationship to block faces of said icosahedron, said fifth large tetrahedron and said fifth small tetrahedron, respectively;

(o). a sixth large tetrahedron provided in said tetrahedron, with block faces of said sixth large tetrahedron disposed in acing relationship to block fiaces of said second icosa pyramid and said icosahedron, respectively; and (p). a sixth small tetdron fitted between said sixth large tetrahedron and said icosahedron, with block faces of said sixth small tetrahedron disposed in facing relationship to block faces of said fourth icosapyramid, said icosahedron and said sixth large tetrahedron, respectively.

7. A multi-polyhedral puzzle comprising a tetrahedron having four tetrahedron faces and four vertices, said tetrahedron conpising a tetrahedron set of polyhedron blocks, each of said tetrahedron set of polyhedron blocks having a plurality of block faces each having one of a plurality of colors, wherein block faces of each of said polyhedron blocks are disposed in facing relationship to block faces of adjacent ones of said polyhedron blocks to define said tetrahedron and said block faces disposed in facing relationship define a pair of block faces on respective adjacent ones of said polyhedron blocks, and said pair of block faces can selectively be matched in color to define a prescribed color pattern on each of said four tetrahedron faces of said tetrahedron; and wherein said tetrahedron set of polyhedron blocks includes a cuboctahedron inscribed in said tetrahedron, whereby four block faces of said cuboctahedron appear on said four tetrahedron faces, respectively, of said tetrahedron.

8. The multi-polyhedral puzzle of claim 7 wherein said tetrahedron set of polyhedron blocks comprises:

(a). a first pentahedron provided in said tetrahedron at a first vertex of said tetrahedron;

(b). a second pentahedron provided adjacent to said first pentahedron, with a block face of said second pentahedron disposed in facing relationship to a block face of said first pentahedron;

(c). a first square pyramid fitted adjacent to said second pentahedron, with a block face of said first square pyramid disposed in facing relationship to a block face of said second pentahedron;

(d). a second square pyramid provided adjacent to said first pentahedron, with a block face of said second square pyramid disposed in facing relationship to a block fice of said first pentahedron and block faces of said cuboctahedron disposed in facing relationship to block faces of said second pentahedron, said first square pyramid and said second square pyramid, respectively;

(e). a third square pyramid provided adjacent to said cuboctahedron, with block faces of said third square pyramid disposed in facing relationship to block faces of said cuboctahedron and said second pentahedron, respectively;

(f). a third pentahedron fitted in said tetrahedron at a second vertex of said tetrahedron;

(g). a fourth pentahedron provided adjacent to said third pentahedron, with a block face of said fourth pentahedron disposed in facing relationship to a block face of said third pentahedron, and a block face of said fourth pentahedron disposed in facing relationship to block faces of said cuboctahedron and said first square pyramid;

(h). a fourth square pyramid fitted between said fourth pentahedron and said cuboctahedron, with block faces of said fourth square pyramid disposed in facing relationship to block faces of said cuboctahedron and said fourth pentahedron, respectively;

(i). a fifth square pyramid fitted between said fourth pentahedron and said cuboctahedron, with block faces of said fifth square pyramid disposed in facing relationship to block faces of said third pentahedron and said cuboctahedron, respectively;

(j). a fifth pentahedron provided in said tetrahedron at a third vertex of said tetrahedron, with a block face of said fifth pentahedron disposed in facing relationship to block faces of said fifth square pyramid, said cuboctahedron and said second square pyramid;

(k). a sixth pentahedron provided adjacent to said fifth pentahedron, with a block face of said sixth pentahedron disposed in facing relationship to a block face of said fifth pentahedron;

(l). a sixth square pyramid fitted between said sixth pentahedron and said cuboctahedron, with block faces of said sixth square pyramid disposed in facing relationship to block faces of said cuboctahedron and said sixth pentahedron, respectively;

(m). a seventh pentahedron provided above said cuboctahedron, with a block face of said seventh pentaedron disposed in facing relationship to block faces of said sixth square pyramid, said cuboctahedron and said third square pyramid; and (n). an eighth pentahedron fitted adjacent to said seventh pentahedron at a fourth vertex of said tetrahedron, with block faces of said eighth pentahedron disposed in facing relationship to block faces of said fourth square pyramid and said seventh pentahedron, respectively.

9. A multi-polyhedral puzzle comprising a tetrahedron having four tetrahedron faces and four vertices, said tetrahedron comprising a tetrahedron set of polyhedron blocks each having a plurality of block faces each having one of a plurality of colors, wherein block faces of each of said polyhedron blocks are disposed in facing relationship to block faces of adjacent ones of said polyhedron blocks to define said tetrahedron, and said block faces disposed in facing relationship define a group of block faces on respective adjacent ones of said polyhedron blocks and said group of block faces can selectively be matched in color to define a prescribed color pattern on each of said four tetrahedron faces, said tetrahedron set of polyhedron blocks comprising:

(a). a first T-tripyramid provided in said tetrahedron at a first vertex of said tetrahedron;

(b). a first T-pentahedron provided in bordering relationship to said first T-tripyramid;

(c). a second T-pentahedron provided in adjacent relationship to said first T-pentahedron, with a block face of said second T-pentahedron disposed in facing relationship to said first T-pentahedron;

(d). a third T-pentahedron provided in adjacent relationship to said second T-pentahedron, with block faces of said third T-pentahedron disposed in facing relationship to block faces of said first T-pentahedron and said second T-pentahedron, respectively;

(e). a first T-tetrahedron provided above said first T-pentahedron, with block faces of said first T-tetrahedron disposed in facing relationship to block faces of said first T-tripyramid and said first T-pentahedron, said first T-tetrahedron inscribed in said tetrahedron, whereby four block faces of said first T-tetrahedron appear on said four tetrahedron faces, respectively, of said tetrahedron;

(f). a fourth T-pentahedron provided adjacent to said third T-pentahedron and said first T-tetrahedron, with block faces of said fourth T-pentahedron disposed in facing relationship to block faces of said third T-pentahedron and said first T-tetrahedron, respectively;

(g). a fifth T-pentahedron provided adjacent to said first T-tetrahedron, opposite said fourth T-pentahedron, with a block face of said fifth T-pentahedron disposed in facing relationship to a block face of said first T-tetrahedron;

(h). a second T-tripyramid fitted in said tetrahedron at a second vertex of said tetrahedron;

(i). a second T-tetrahedron provided adjacent to said second T-tripyramid, with block faces of said second T-tetrahedron disposed in facing relationship to block faces of said second T-tripyramid and said third T-pentahedron, respectively;

(j). a sixth T-pentahedron fitted between said second T-tetrahedron and said fourth T-pentahedron, with block faces of said sixth T-pentahedron disposed in facing relationship to block faces of said second T-tetrahedron and said fourth T-pentahedron, respectively;

(k). a sixth T-pentahedron provided above said fourth T-pentahedron, with block faces of said sixth T-pentahedron disposed in facing relationship to block faces of second T-tetrahedron and said fourth T-pentahedron, respectively;

(l). a third T-tripyramid provided in said tetrahedron at a third vertex of said tetrahedron;

(m). a third T-tetrahedron provided adjacent to said third T-tripyramid, with block faces of said third T-tetrahedron disposed in facing relationship to block faces of said third T-tripyramid and said second pentahedron, respectively;

(n). a seventh T-pentahedron provided adjacent to said third T-tetrahedron, with block faces of said seventh T-pentahedron disposed in facing relationship to block faces of said third T-tetrahedron, said first T-pentahedron and said fifth T-pentahedron, respectively;

(o). an eighth T-pentahedron fitted between said fourth T-pentahedron and said sixth T-pentahedron, with block faces of said eighth T-pentahedron disposed in facing relationship to block faces of said fourth T-pentahedron, said fifth T-pentahedron and said sixth T-pentahedron, respectively;

(p). a ninth T-pentahedron fitted between said fifth T-pentahedron and said seventh T-pentahedron, with block faces of said ninth T-pentahedron disposed in facing relationship to block faces of said fifth T-pentahedron and said seventh T-pentahedron, respectively;

(q). a tenth T-pentahedron provided between said second T-pentahedron and said second T-tetrahedron, with block faces of said tenth T-pentahedron disposed in facing relationship to block faces of said second T-pentahedron and said second T-tetrahedron, respectively;

(r). an eleventh T-pentahedron fitted between said tenth T-pentahedron and said third T-tetrahedron, with block faces of said eleventh T-pentahedron disposed in faicing relationship to block faces of said third T-tetrahedron, said seventh T-pentahedron and said tenth T-pentahedron, respectively;

(s). a twelfth T-pentahedron fitted between said tenth T-pentahedron and said eleventh T-pentahedron, with block flces of said twelfth T-pentahedron disposed in facing relationship to block faces of said sixth T-pentahedron, said tenth T-pentahedron and said eleventh T-pentahedron, respectively, (t). a fourth T-tetrahedron fitted in inverted position between said eighth T-pentahedron, said ninth T-pentahedron and said twelfth T-pentahedron, with block faces of said fourth T-tetrahedron disposed in facing relationship to block faces of said eighth T-pentahedron, said ninth T-pentahedron and said twelfth T-pentahedron, respectively; and (u). a fourth T-tripyramid provided in said tetrahedron above said fourth T-tetrahedron and at a fourth vertex of said tetrahedron, with a block face of said fourth T-tripyramid disposed in facing relationship to a block face of said fourth T-tetrahedron.

* * * * *